US006769380B1

(12) United States Patent
Carvajalino et al.

(10) Patent No.: US 6,769,380 B1
(45) Date of Patent: Aug. 3, 2004

(54) MODULAR MARKER

(75) Inventors: Mario Carvajalino, Bogota (CO); Luis Angarita, Bogota (CO)

(73) Assignee: Producciones Generales-Progen S.A., Bogota (CO)

( * ) Notice: Subject to any disclaimer, the term of this patent is extended or adjusted under 35 U.S.C. 154(b) by 0 days.

(21) Appl. No.: 10/190,238

(22) Filed: Jul. 5, 2002

(51) Int. Cl.[7] ..... E01F 9/00

(52) U.S. Cl. ..... 116/63 P; 116/63 R; 404/6; 256/32; 403/343

(58) Field of Search ..... 116/63 P, 63 R, 116/63 C; 40/605, 606, 612; 404/6, 9; 403/243, 299, 300, 301, 315, 316, 359.1, 395, 546; 256/32, 19, 29, 59, 65.01, 65.02, 65.03

(56) References Cited

U.S. PATENT DOCUMENTS

| | | | | | |
|---|---|---|---|---|---|
| 673,484 | A | * | 5/1901 | Soles | 256/58 |
| 3,119,588 | A | * | 1/1964 | Keats | 248/158 |
| 4,364,546 | A | * | 12/1982 | Lyman et al. | 256/24 |
| 4,408,748 | A | * | 10/1983 | Lewis | 256/11 |
| 4,511,281 | A | * | 4/1985 | Schmanski | 404/10 |
| 4,655,630 | A | * | 4/1987 | Rinehart | 403/342 |
| 4,668,119 | A | * | 5/1987 | Galletti | 403/349 |
| 4,674,431 | A | * | 6/1987 | Cory | 116/63 P |
| 4,772,869 | A | | 9/1988 | Grammas et al. | |
| 5,269,251 | A | | 12/1993 | Freeman | |
| 5,364,076 | A | * | 11/1994 | Nicholls | 256/22 |
| 5,908,262 | A | * | 6/1999 | Ahn | 404/9 |
| 5,938,361 | A | * | 8/1999 | Yasunaga | 401/209 |
| 6,014,941 | A | * | 1/2000 | Bent et al. | 116/63 R |
| 6,053,657 | A | | 4/2000 | Signorelli | |
| D432,935 | S | * | 10/2000 | Bent et al. | D10/113 |
| 6,517,280 | B2 | * | 2/2003 | Carter | 404/6 |
| 6,536,369 | B1 | * | 3/2003 | Bent et al. | 116/63 P |

FOREIGN PATENT DOCUMENTS

| | | | |
|---|---|---|---|
| DE | 4012459 | A | * 10/1991 |

* cited by examiner

*Primary Examiner*—Christopher W. Fulton
*Assistant Examiner*—Tania C. Courson

(57) ABSTRACT

A modular marker comprised of one or more modular sections that may be secured together to provide a control device for controlling the flow of vehicles or people. The modular marker is comprised of a base member, a cap member, and may include one or more tubular members for extending the height of the marker and for receiving webs, tapes, chains, ropes, wood slats, or metal bars for the construction of a barrier. The modular sections easily interlock with each other and include a security thread to enable secure interlocking of the modular sections. The modular sections include vertical slots to enable easy insertion of preprinted marker tapes or other appropriate cross members to provide rapid construction of a barricade appropriate to the situation in which it is used.

7 Claims, 31 Drawing Sheets

MODULAR MARKER

FIELD OF THE INVENTION

The present invention relates to control devices for controlling the flow of vehicles or people, and more particularly to a modular marker that is capable of being placed in a series to support ropes, tapes, chains, or similar barricade delineators for the control of vehicular or pedestrian traffic. Since it is modular, the traffic marker is capable of being assembled in a variety of configurations to form barricades for specific control situations. The traffic marker can also be used in a stand-alone configuration to support signs, lights, or similar objects to call attention to a hazard, direct pedestrians, or provide important information.

BACKGROUND OF THE INVENTION

Many traffic control devices have been proposed for the control of vehicular or pedestrian traffic in airports, streets, construction areas, businesses, and numerous other locales. These traffic control devices typically consist of pylons that are molded of plastic and are of either single-piece construction or of a series of pieces that are capable of breaking down to reduce space requirements for storage. The prior art traffic control devices however are typically not of modular construction and therefore can only be set up in one configuration. They are therefore limited in usefulness as their single configuration enables their use for only one specific application.

U.S. Pat. No. 4,772,869 to Grammas et al., issued Sep. 20, 1988, for example, discloses a communication apparatus that is capable of displaying visual information thereon. A specific embodiment of the communication apparatus has a support having upright side walls and a top wall forming a pentahedron. Provision is made for weight means to be inserted into pockets around the lower edge of side walls. Although the communication apparatus of patent '869 provides a means of displaying communications, it is not modular and capable of being tailored for a special use.

U.S. Pat. No. 6,053,657 to Signorelli, issued Apr. 25, 2000 discloses a safety or traffic marker including a base portion and an upper portion with the base portion configured for facilitating upright placement of the marker on a surface. The upper portion of the marker is divided into two separate sections for receiving a tape dispenser therein and for dispensing an elongated strip of tape or safety material. Although the upper portion of the marker can accommodate different signage devices, the overall height of the marker is not adaptable for special uses.

U.S. Pat. No. 6,182,600 to Brown et al., issued Feb. 6, 2001 discloses a traffic channeling device including a delineator stem with hollow upper and lower portions and with the upper portion stepped inwardly along its axial length. The hollow construction and stepped surfaces enable several of the traffic channeling devices to be stacked upon each other. Although the traffic channeling device of the '600 patent enables reduced space requirements for storage, the device is not modular and therefore not capable of being easily reconfigured to suit different traffic control applications.

There is therefore a need for a traffic control device that is modular, and therefore provides the ability to be configured for specific applications including modular assembly to accommodate various heights and to meet various specific uses.

OBJECTS AND ADVANTAGES OF THE INVENTION

The present invention therefore provides a modular traffic marker that provides several advantages over current state of the art traffic control devices that arc intended to control the flow of pedestrian or vehicular traffic around a given area.

A significant advantage provided by the modular marker of the present invention is that it is of modular construction, and therefore can easily be tailored at the site to many different configurations to fit the requirements of the application. The modular construction enables the marker to be set up as either a signaling device, capable of displaying a sign, or as a barricade. The modules also enable construction of traffic markers of various heights.

The modules of the present invention include rounded sides, therefore providing no sharp edges that could be harmful to pedestrians or vehicular traffic.

The modules are constructed in high visibility colors, additionally improving the safety of the invention.

The tubular modules include thick side walls that are of solid construction, thereby improving the stability of the modular marker.

Another advantage is that the modules are easily assembled together, allowing quick field assembly of the modular marker of the present invention.

An additional advantage is provided by a security thread feature, which enables the modules to be locked tightly together and not be easily disassembled.

Another advantage is the inclusion of cylindrical surfaces on each module for easy acceptance of and minimal wastage of expensive reflective tape.

Although the security thread feature provides secure connection of the modules to one another, a feature is provided to allow modules to be disassembled and reassembled in other configurations if desired. This provides the advantage of easy reconfiguration of the modular marker when desired.

The modular marker is configured to accommodate either ropes or tapes for forming barricade delineators.

Another advantage is that the modular marker is very stable. The base member can be provided in various sizes to increase or decrease the stability as desired.

The modular marker has the advantage of being versatile, able to accept signs for use as a marker or able to accept ropes, tapes, or similar items for configuration as a barricade.

The modular marker may be constructed in a theft-resistant version, which provides enhanced security against theft of inserted tapes.

Enhanced visibility is provided by the modular marker, as provision is made for attachment of lights to the markers.

An advantage is provided by inclusion of tape holding slots within each modular section, thereby enabling marker tape to be channeled through the modular sections.

The base member of the modular marker includes grooves for allowing passage of surface water thereby preventing the markers from being moved by surface water runoff.

The base member of the present invention includes a convoluted bottom surface to provide a more stable platform on uneven ground such as sand or unpaved areas.

An additional advantage of the modular marker and all its components is that it may easily and inexpensively be molded and mass produced out of polymeric materials, although it could also be constructed of wood, metal, or a variety of materials.

These, and other objects, will become readily apparent to one of skill in the art after reading this disclosure.

BRIEF DESCRIPTION OF THE INVENTION

To provide an easily assembled yet secure traffic marker and accomplish the other aforementioned advantages, the applicant has devised a novel modular traffic marker device. The device includes tubular modules, a base, and a cap that are preferably molded of polymeric materials, but may be constructed of wood, metal, or a variety of materials. One or more of the modules may be assembled with the base and cap to provide a traffic marker appropriate for the traffic situation for which it is intended, including the posting of signs or the construction of barricades. The modular sections easily interlock with each other and a security thread is provided to enable secure interlocking of the modules to the base member and the cap member. The modular sections include vertical slots to enable easy insertion of preprinted marker tapes to provide rapid construction of a barricade appropriate to the situation in which it is used.

REFERENCE NUMERALS USED IN THE SPECIFICATION AND DRAWINGS

40—modular marker
42—tubular member
42A—first or bottom tubular member
42B—second or middle tubular member
42C—third or top tubular member
44—base member
46—cap member
48—stable surface

50—light
52—longitudinal slot
54—aperture (in cap member)
56—first or top end (of tubular member)
56A—first or top end (of tubular member)
58—second or bottom end (of tubular member)
58B—second or bottom end (of tubular member)
60—extension
62—exterior threads
64—longitudinal ribs
66—shoulder
68—non-threaded area
70—outer periphery (of tubular member)
72—interior threads
74—inner periphery (of tubular member)
76—lateral teeth
78—long surface (of teeth)
80—short surface (of teeth)
82—security thread or fastening and locking arrangement
84—bottom (of base member)
86—top extension (of base member)
88—exterior threads (of base member)
90—grooves
92—convoluted surface
94—horizontal opening
96—recessed areas
98—side walls (of longitudinal slot)
100—center (of slot)
102—outer edges (of slot)
104—tubular member (alternate embodiment without horizontal opening)
106—short modular marker (alternate embodiment)
108—reflective tape
110—intermediate height modular marker (alternate embodiment)
112—joint
114—cap member (alternate embodiment)
116—panel area
118—long length tubular member (alternate embodiment)
120—intermediate length tubular member (alternate embodiment)
122—top portion (of cap member)
123—rope
124—barricade (alternate embodiment)
126—barricade
128—marker tape
130—sign or panel
132—barricade (alternate embodiment)
134—sign
136—short caution cone

DETAILED DESCRIPTION

As this invention may be more easily explained by reference to the attached drawings, it should be noted that the figures are representative and exemplary of the invention only, and should not be construed as limiting the scope of the invention in any way.

The present invention, a modular traffic marker, is suitable for channeling pedestrian or vehicular traffic or for displaying signs for providing messages to alert people to hazards or other important conditions.

Figure 26:
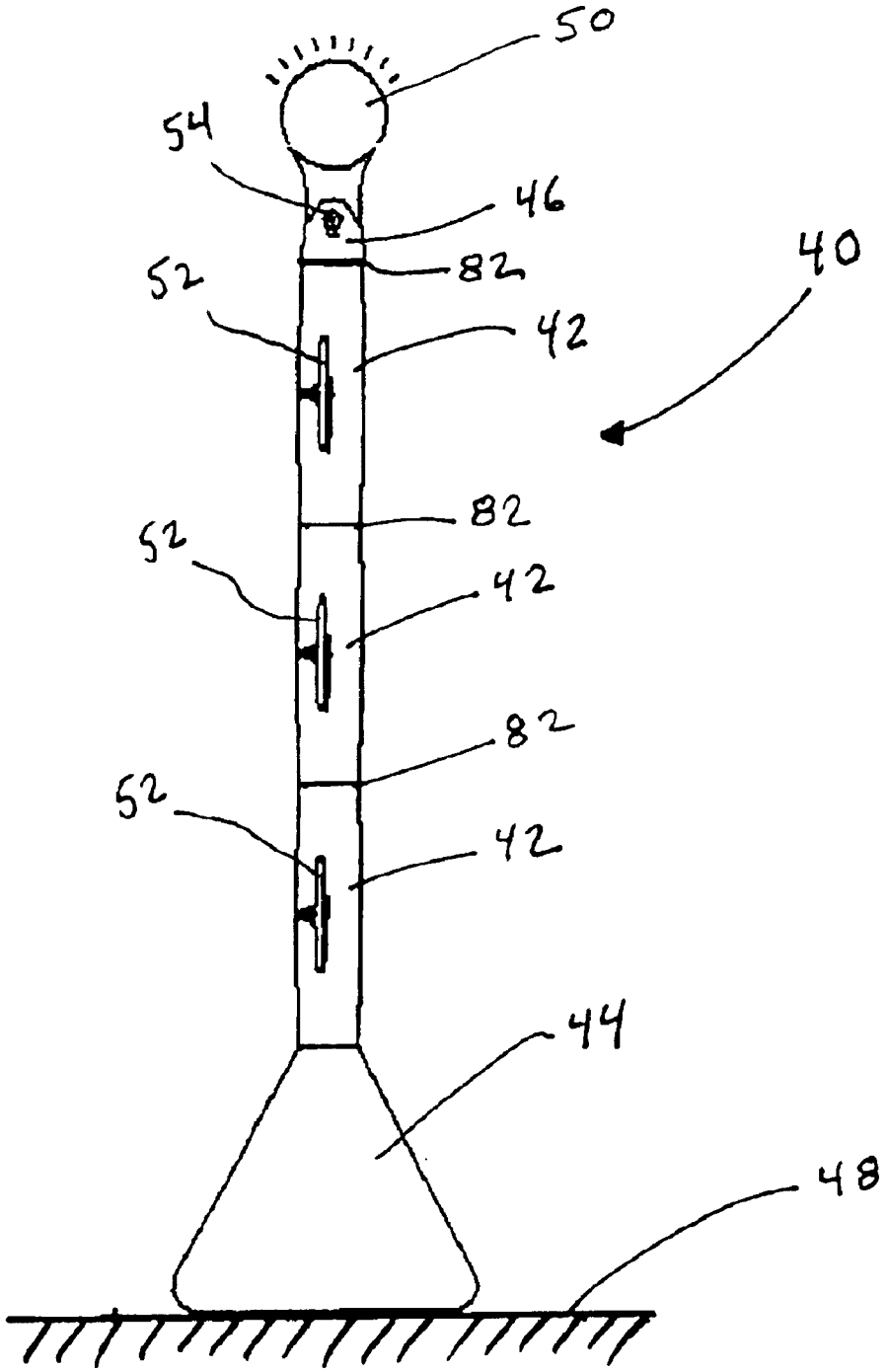
FIG. 26 is a side elevational view of a modular marker constructed with three tubular members according to FIG. 7 and including a light fixture secured to the cap.

Referring to FIG. 26, a side elevational view is shown of the preferred embodiment of the modular marker device of the present invention. The modular marker 40 includes one or more tubular members 42, a base member 44, and a cap member 46 which are all modular and easily secured together. The modular nature of the tubular member 42, base 44, and cap 46 allow the modular marker 40 be assembled in various configurations, only one of which, a lighted traffic marker, is shown in FIG. 26. With reference to the subsequent description along with reference to the attached drawings, it will become obvious to anyone skilled in the art that the modular marker of the present invention exhibits great flexibility and can be configured for many traffic control situations.

As shown in FIG. 26, the base member 44 is typically placed on a surface 48, and, for this configuration, three tubular members 42 are attached to the base member 44 to achieve the proper height for displaying the light 50. The preferred embodiment of the modular marker 40 typically includes longitudinal slots 52 in each of the tubular members 42 and an aperture 54 in the cap member 46. These features of the modular marker will become clear to one skilled in the art by reading the following discussion and reference to the attached drawings.

Figure 7:
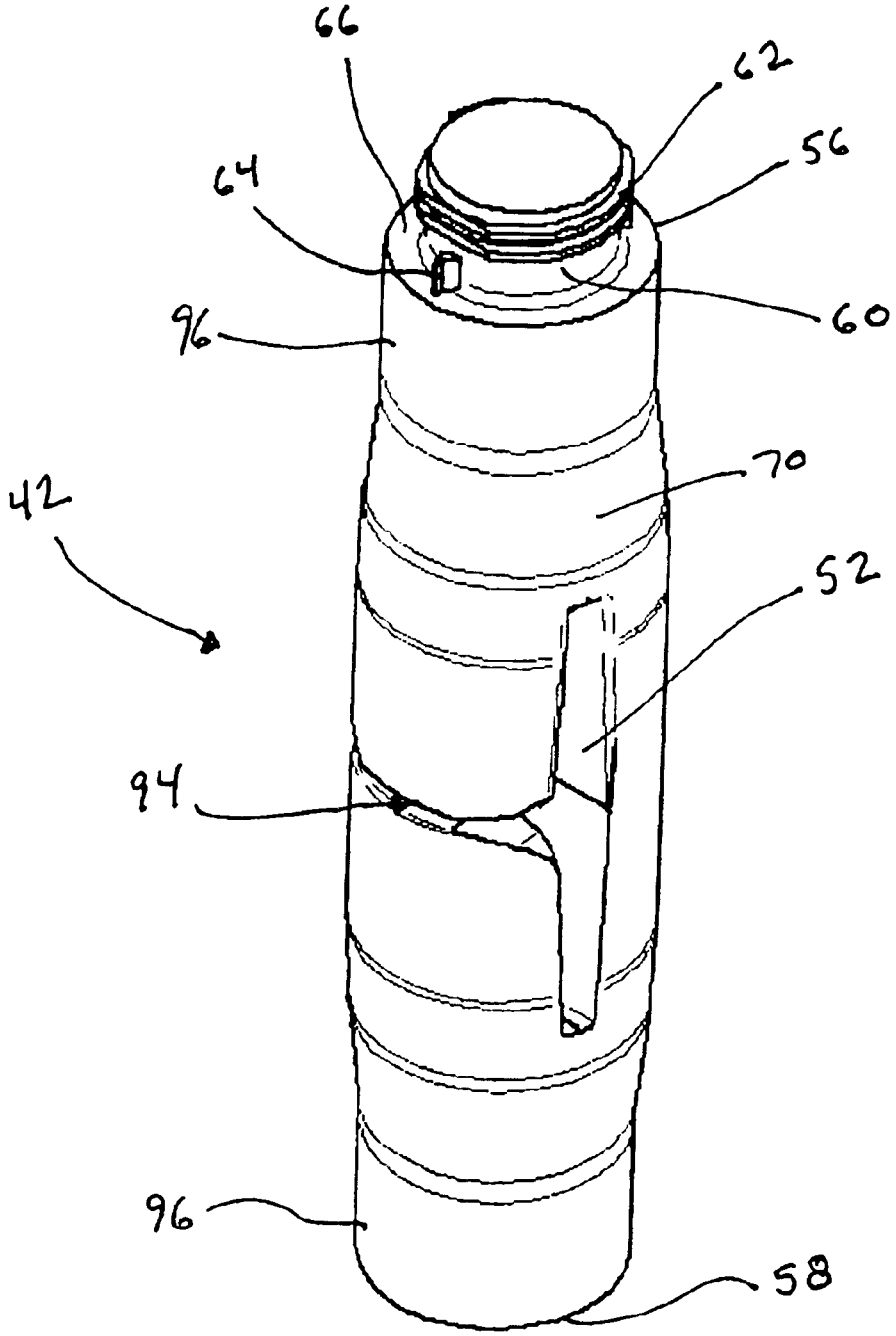
FIG. 7 is a perspective view of a preferred embodiment of the tubular member of the present invention.

Referring now to FIG. 7, the preferred embodiment of the tubular member 42 includes the longitudinal slot 52 which is located approximately centrally in the tubular member 42. The tubular member 42 includes two ends 56, 58 that are designed to provide a security thread, or fastening and locking arrangement, for rapidly securing two or more of the tubular members together. The first end 56 includes an extension 60 that is of a smaller diameter than the body of the tubular member 42. The extension 60 includes exterior threads 62 near its end and one or more longitudinal ribs 64 at the shoulder 66 formed by the juncture with the body of the tubular member 42.

Figure 6:
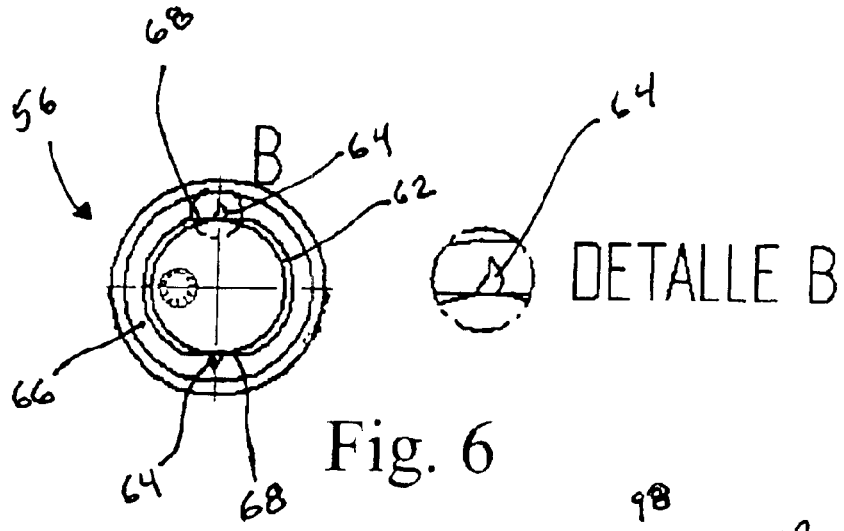
FIG. 6 is a top view of the tubular member of FIG. 5.

Details of the first end 56, the exterior threads 62, and the longitudinal ribs 64 are shown in more detail in the top view of the tubular member 42 and the detail of the longitudinal rib 64 in FIG. 6. The exterior threads 62 are discontinuous, although they extend around most of the outer periphery of the extension 60, with the longitudinal ribs 64 extending from the non-threaded area 68. The longitudinal ribs 64 extend farther from the outer periphery of the extension 60 than do the exterior threads 62.

Figure 6A:
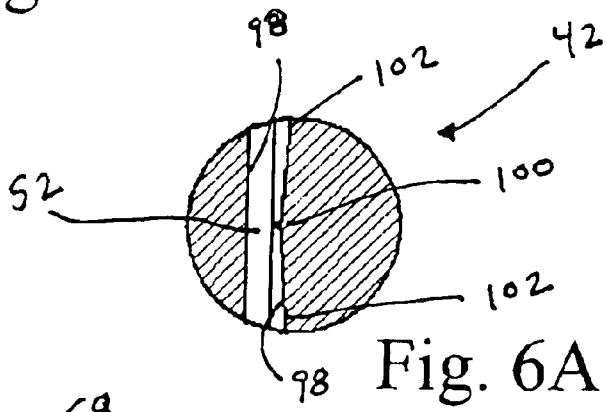
FIG. 6A is a sectional view of the tubular member taken along line A—A of FIG. 5A.
Figure 6B:
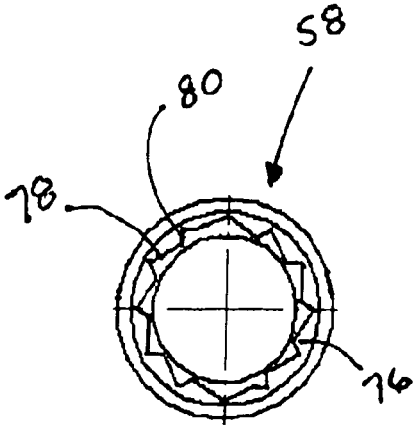
FIG. 6B is a bottom view of the tubular member of FIG. 5.
Figure 6C:
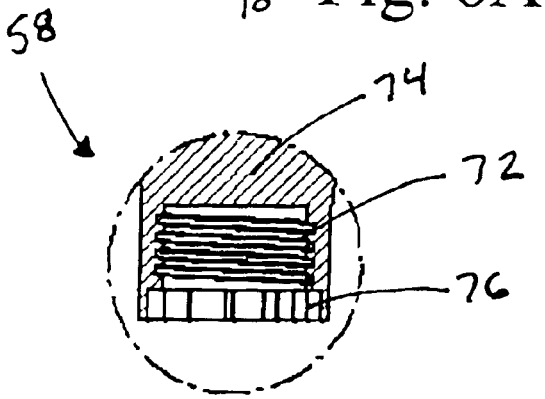
FIG. 6C is a sectional view of the tubular member taken longitudinally through the tubular member at detail area "C" in FIG. 5.

Details of the second end 58 of the tubular member 42 can be understood by reference to FIGS. 6B and 6C. As shown in FIG. 6C, the second end 58 of the tubular member 42 includes interior threads 72 on the inner periphery 74 of the tube and, nearer the second end 58, a plurality of lateral teeth 76. Referring to FIG. 6B, details of the lateral teeth 76 show they are formed with a long surface 78 and a short surface 80.

Figure 9:
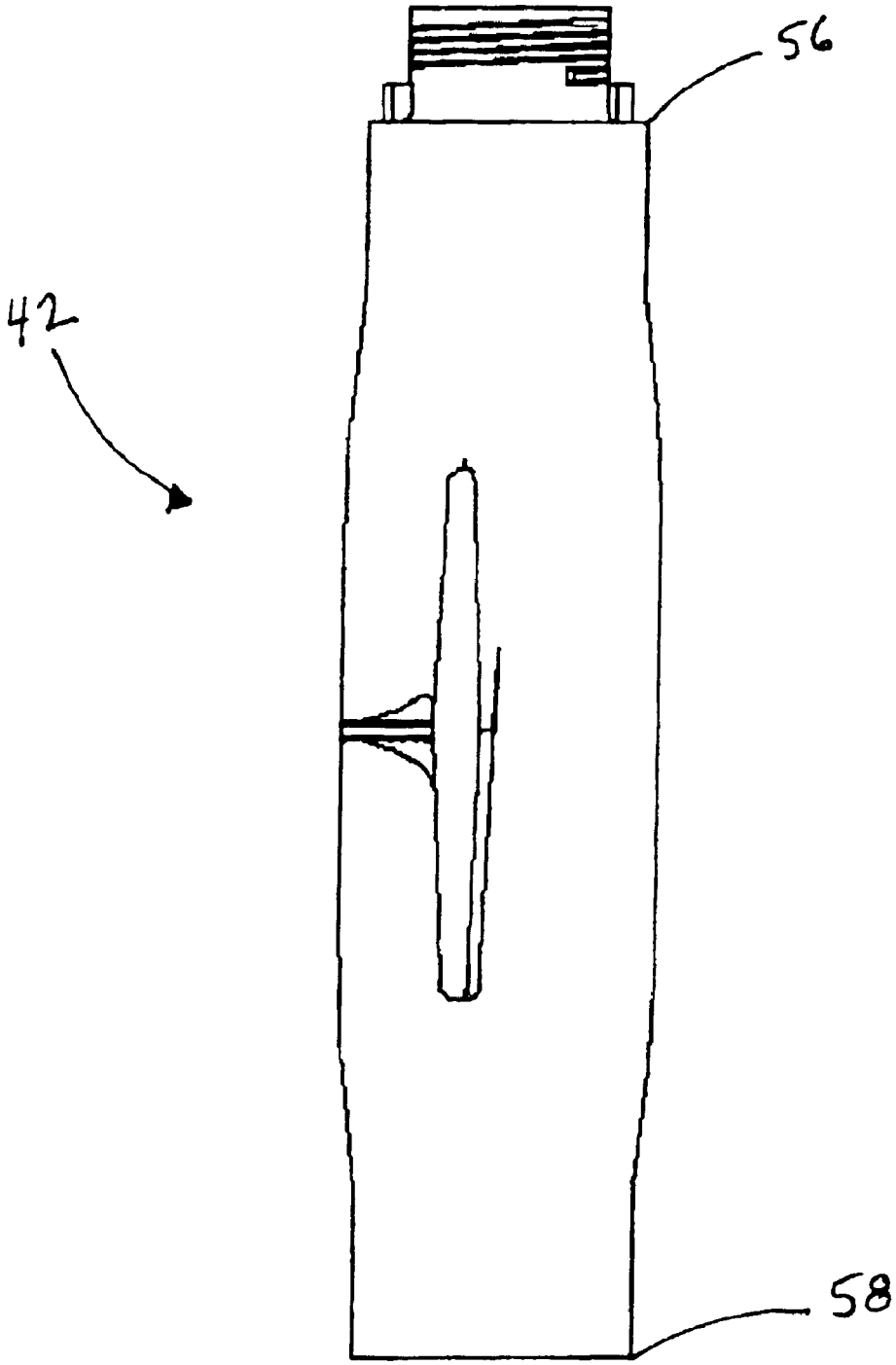
FIG. 9 is a side elevational view showing the tubular member of FIG. 8 rotated 90° to the left.

It should be stated at this point that the first 56 and second 58 ends of the tubular member 42 as shown in FIG. 9 are designed to enable securing a plurality of tubular members together, such as shown in FIG. 26, to configure a modular marker according to the specific needs of the user. Therefore, the first end 56, the details of which are shown in FIG. 6, is designed to cooperate with the design of the second end 58, as shown by the details of FIGS. 6B and 6C. To operate the invention, referring to the exploded view of the modular marker 40 in FIG. 11, a user would typically connect two or more tubular members 42, the base member 44 and the cap member 46. Tubular members would be connected by inserting the first end 56A of a first tubular member 42A into the second end 58B of a second tubular member 42B and rotating the first end 56A of the first member 42A clockwise into the second end 58B of the second tubular member 42B. The design of the first 56 and second 58 ends of the tubular member 42 form a security thread, or fastening and locking arrangement 82, which cooperate to securely lock the two members together.

Referring again to FIGS. 6, 6B, and 6C, insertion and clockwise rotation of the first end 56 into the second end 58 starts a connection sequence in which the exterior threads 62 on the first end 56, extending to a lesser diameter than the lateral teeth 76 of the second end 58, slide easily past the teeth 76 and contact the interior threads 72 of the second end 58. Continued clockwise rotation of the first end 56 into the second end 58 causes the exterior threads 62 on the first end 56 and the interior threads 72 on the second end to mesh and thread together. Continued clockwise rotation causes the longitudinal ribs 64 on the first end 56 to contact the long surface 78 of the teeth 76 and, since the longitudinal ribs 64 extend to a greater diameter than the inner diameter of the teeth 76, ride up the slight incline provided by the long surface 78. Continued clockwise rotation causes the longitudinal ribs 64 to successively ride up each long surface 78 until the second end 58 eventually contacts the shoulder 66 of the first end 56. At this point the two tubular members are fastened securely together. Counterclockwise rotation of the first tubular member with respect to the second tubular member causes the longitudinal ribs 64 to contact the short surfaces 80 of the teeth 76. As the short surface 80 of the teeth 76 is of a much steeper incline with respect to the rotating longitudinal ribs 64, quite a bit of resistance is created to unfastening of the tubular members. The fastening and locking arrangement 82 of the present invention therefore forms a security thread that is very effective to prevent unwanted tampering and separation of the tubular members.

Now referring again to FIG. 11 it can be discerned by the practitioner that the base member 44 may include exterior threads (not shown) and longitudinal ribs (not shown) similar to the first end 56 of the tubular member 42 to facilitate a security thread between the base 44 and bottom tubular member 42A. Similarly, cap member 46 can include lateral teeth 76 and interior threads 72, as shown in FIGS. 30B and 30D, to provide a security thread between the cap member 46 and the topmost tubular member.

It should be pointed out at this time that the first end 56 of the tubular member 42, as shown in FIG. 9, may be referred to also as the top end 56, as it will always be oriented vertically with the first end up for assemblage of the modular marker. Second end 58 can therefore also be referred to interchangeably as the bottom end 58, as it will always be oriented down.

Figure 1:
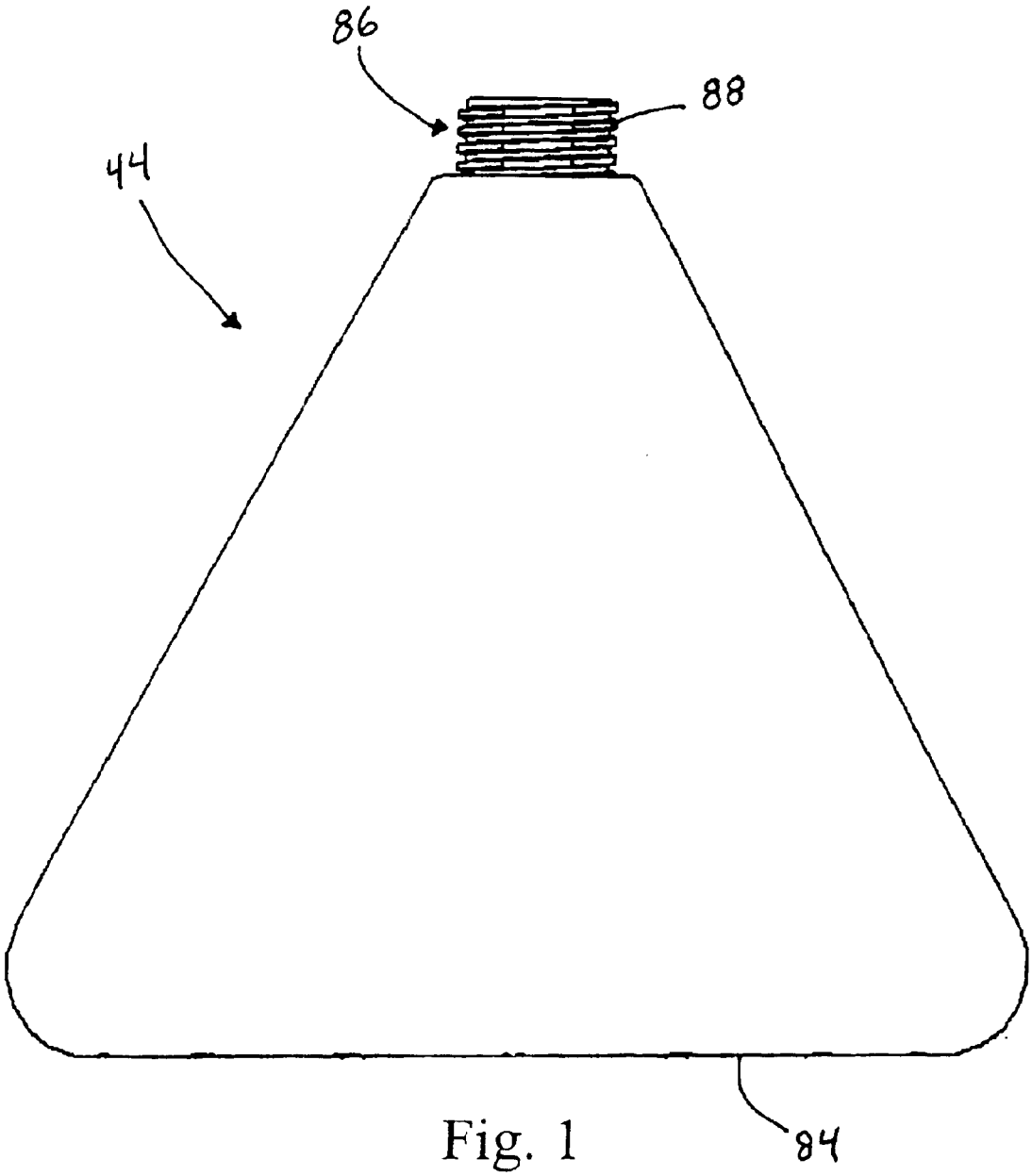
FIG. 1 is a side elevational view of the base member of the present invention.
Figure 2:
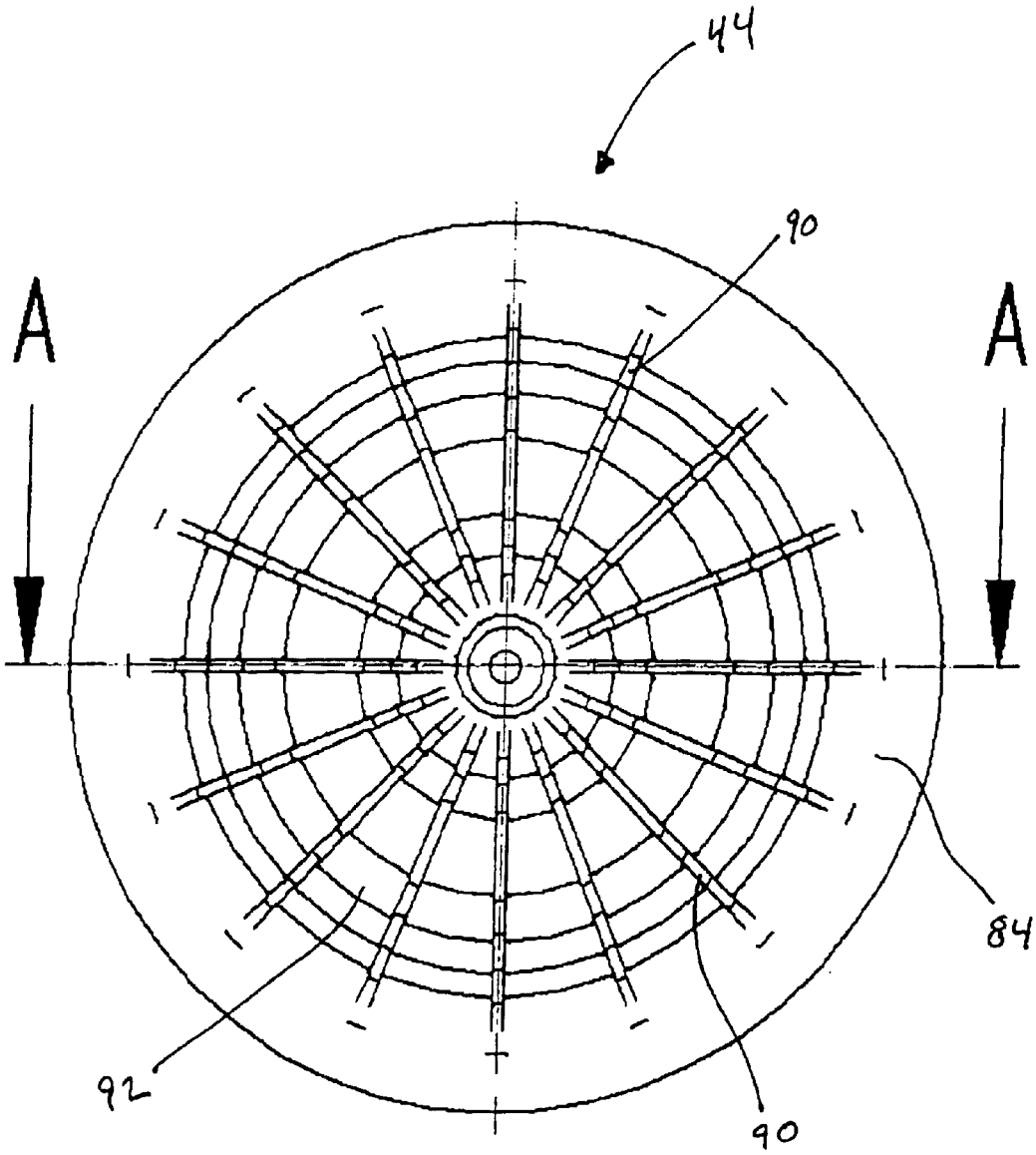
FIG. 2 is a bottom view of the base member shown in FIG. 1.
Figure 3A:
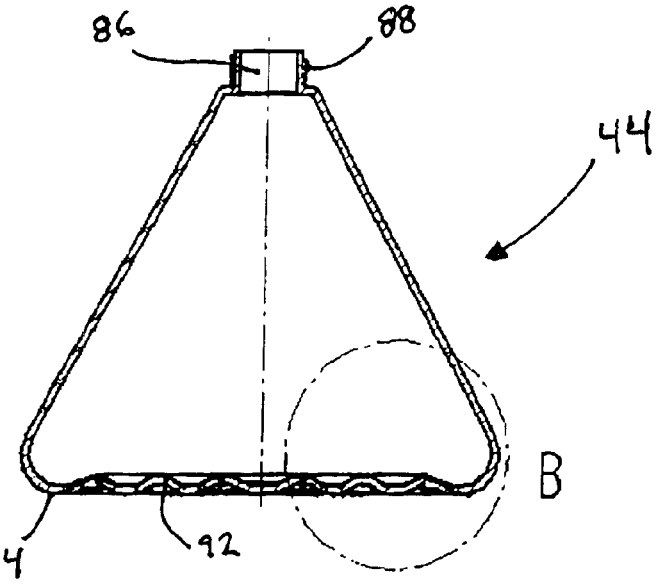
FIG. 3A is a sectional view of the base member taken along lines A—A of FIG. 2.

Referring to FIGS. 1, 2, and 3, the preferred embodiment of the base member 44 of the present invention includes a bottom 84 that allows the base member to be set on supporting surface such as a floor, a street surface, or the ground. A top extension 86 contains exterior threads 88 that will mesh with the interior threads of the bottom end of a tubular member (not shown). It is preferred that base member 44 be hollow, as shown in FIG. 3A, to allow for easy transport to a traffic control site. Once at the site, and placed on a supporting surface, the base member 44 may be filled with sand, water, or similar materials to provide ballast or weight for supporting the base member 44 and the additional modular members that are attached to it to form a modular marker according to the present invention. Although it is preferred that the base member 44 be hollow, it could easily be formed of a solid material that provides instant weight for stabilizing the modular marker.

Figure 3B:
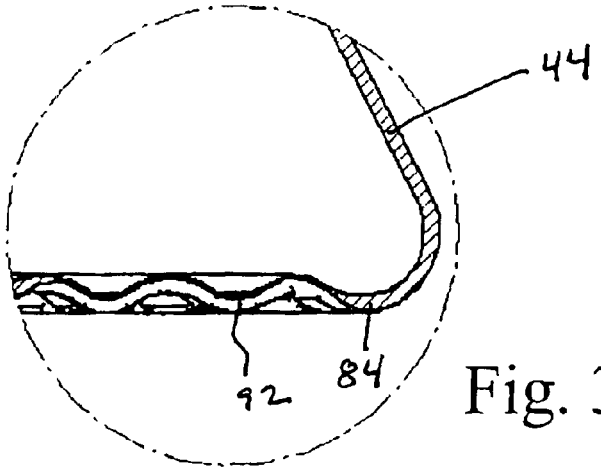
FIG. 3B is a detailed sectional view of a portion of the base of FIG. 3.

Referring to FIG. 2, it is preferred that the bottom 84 of the base member 44 include grooves or channels 90 to facilitate removal of surface water runoff when the modular marker is used outdoors. The preferred arrangement of the grooves 90 is radially outward from the center of the bottom 84 of the base member 44 as shown, to allow easy placement of the base member 44 in any orientation with respect to a prevailing slope and still allow water runoff to run beneath it. It is also preferable that the bottom 84 include a convoluted or wavy surface 92, as shown in FIG. 3B, to provide a more stable platform when the base member 44 is placed on uneven or soft ground, such as sand.

Although FIG. 1 shows the base member 44 with exterior threads 88 that cooperate with the bottom end of a tubular member (not shown) for a rapid securement of the base to a tubular member, the top extension 86 could also be provided with longitudinal ribs (not shown) at the base of the threads to provide a security thread similar to that of the tubular members. This would provide a more permanent connection of the base member to the tubular member (not shown).

Referring to FIG. 7, it can be seen that the preferred embodiment of the tubular member 42 also includes a horizontal opening 94 from the outer periphery 70 of the tubular member 42 into the longitudinal slot 52. The horizontal opening 94 allows a tape, such as a printed emergency tape, to be fed rapidly into the slot 52. There are now available commercially produced barrier tapes which are typically printed with warning messages such as "POLICE—EMERGENCY", "CAUTION—WET FLOOR", "NO PARKING", "WARNING—CONSTRUCTION AREA", "WARNING—SAFETY GLASSES REQUIRED", etc. These barrier tapes are typically constructed of bright, highly visible colors and may include highly visible bands of additional colors to draw attention to the barrier. The longitudinal slot 52 is therefore oriented longitudinally through the tubular member 42 to allow good visibility of the barrier tape and its printed message. The longitudinal slots 52 provide a means to carry the tape without folding or bending it, thereby adding a prominent feature to the modular marker that is not available in the prior art. The preferred size of the longitudinal slot 52 is typically 0.25 to 0.75 inches wide by 4 to 6 inches length to accommodate the wide tapes commercially available, although other the slot can be provided in other sizes for other specific applications. The horizontal opening 94 is typically 0.125 to 0.25 inches in width to allow entry of the tape into the longitudinal slot 52, although narrower or wider openings can be provided for specific applications. A wide tape, typically 4 to 5 inches in width, would be typically installed in the slot by inserting a first side of the tape into the opening 94, pushing the tape (not shown) into one end of the longitudinal slot 52 until the tape is bunched in that end and totally within the slot 52, and then straightening the tape by pushing the second side of the tape to the opposite end of the slot 52. The barrier tapes are typically constructed of stiff material and therefore tend to easily straighten out when inserted in the foregoing manner.

Figure 8:
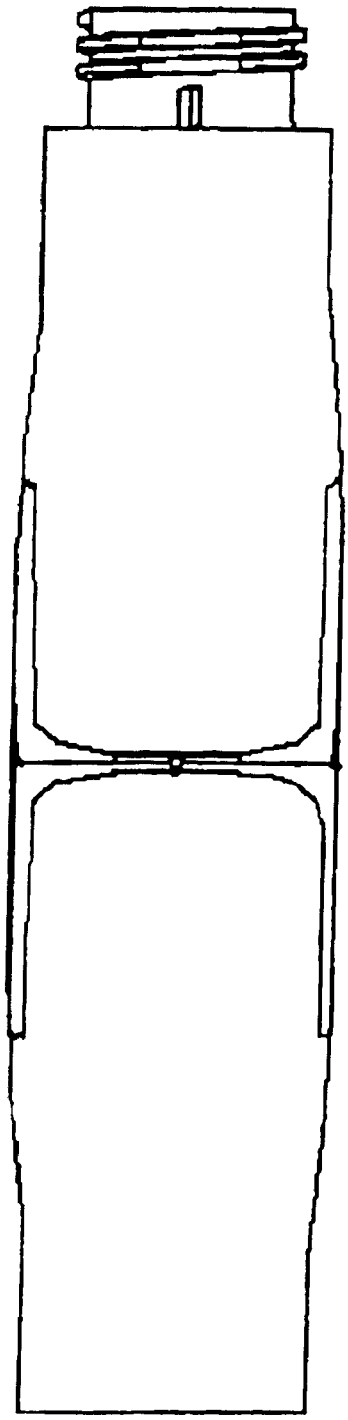
FIG. 8 is a side elevational view of the tubular member of FIG. 7.

As also shown by reference to FIGS. 7, 8, and 9, the preferred embodiment of the tubular member 42 typically is narrower in diameter at each end than in the center creating recessed areas 96 near each end 56, 58. The wider center allows the longitudinal slot 52 to provide more surface area for securely holding a barrier tape (not shown). The recessed areas 96 include perfectly cylindrical sides to provide a location for reflective tape to be applied to the modular marker after it is assembled. Reflective tape is typically very expensive. The narrow diameter and cylindrical sides of the recessed areas 96 therefore provide an area for application of reflective tape that will minimize usage and wastage of the tape. The diameter of the tubular member 42 is typically 2.75 inches, although narrower or wider diameters could be provided if warranted by a specific application.

Figure 5:
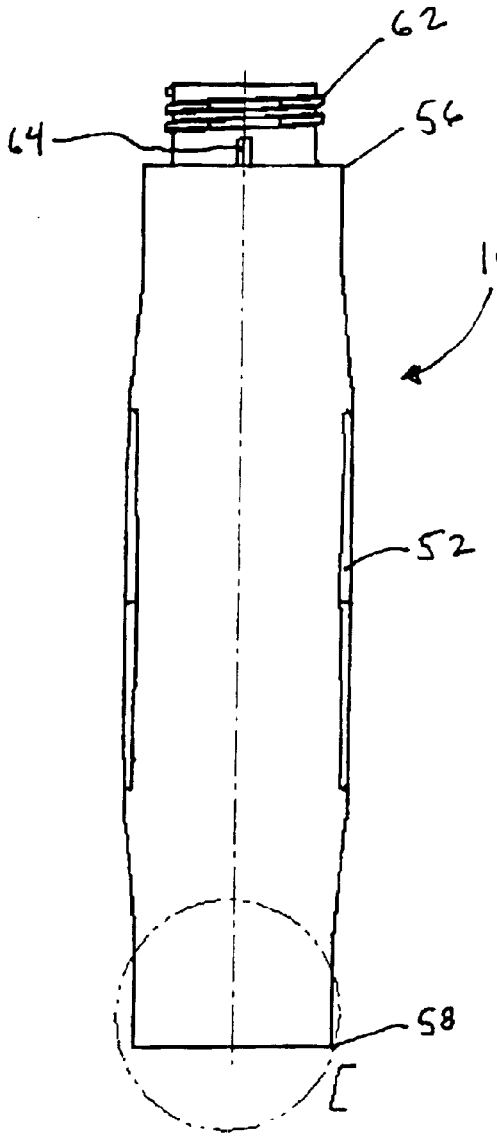
FIG. 5 is a side elevational view of the tubular member of FIG. 4.
Figure 5A:
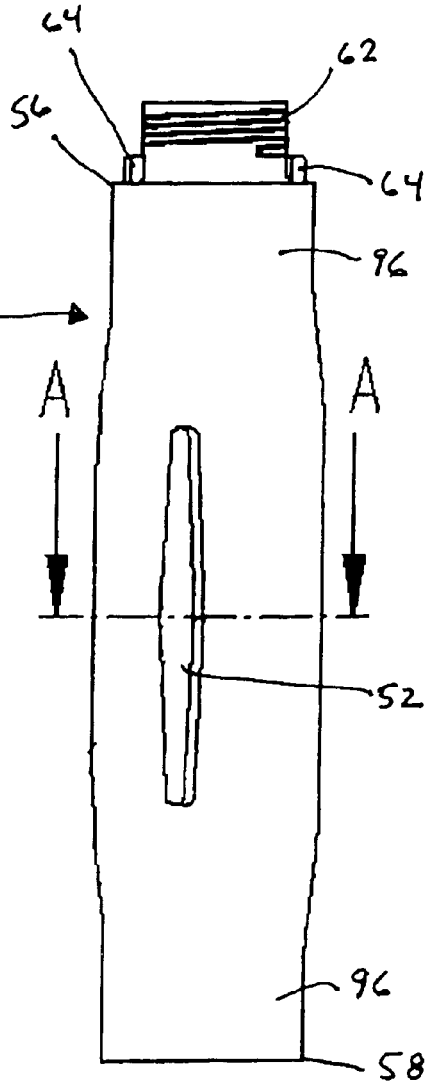
FIG. 5A is a side elevational view of the same tubular member of FIG. 5 but rotated 90° to the left.

Further details of the longitudinal slot 52 may be discerned by reference to FIG. 6A which is a cross-sectional view taken along line A—A of FIG. 5A. The tubular member 42 is preferably blow molded from a polymeric material and therefore the longitudinal slot 52 is typically enclosed by side walls 98. The slot 52 is preferably narrower in the center 100 of the slot 52 than at the outer edges 102. The narrower center 100 facilitates better gripping and holding of the barrier tape that will later be inserted into the slot 52. The cross-sectional dimensions of the slot 52 is typically 0.58 inches wide at the outer edge 102 and typically 0.44 inches at the center 100, although these dimensions can be changed if desired for a special application.

Figure 4:
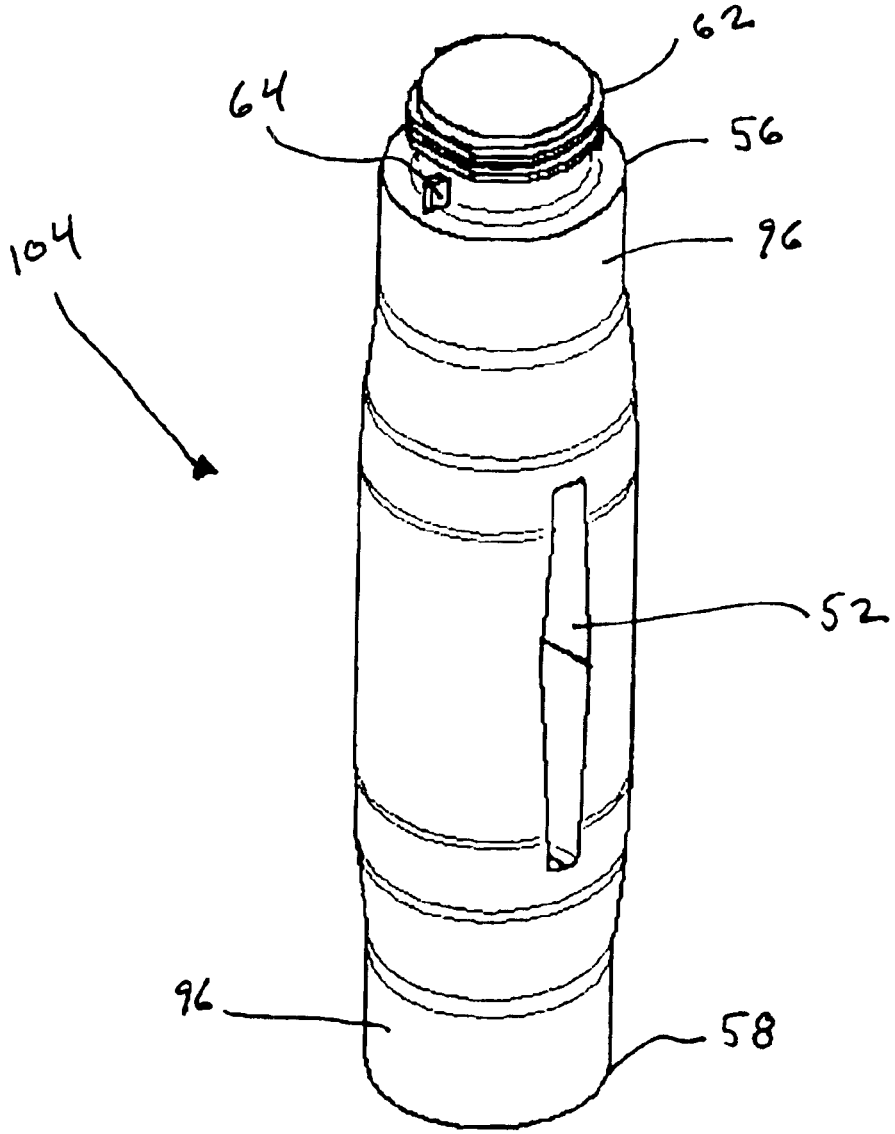
FIG. 4 is a perspective view of an alternate embodiment of the tubular member of the present invention.

FIGS. 4, 5, and 5A show an alternate embodiment of the tubular member of the modular marker. The alternate tubular member 104 includes a longitudinal slot 52 that does not include a horizontal opening into the slot. This embodiment of the tubular member is used in those applications in which tampering or theft of the barrier tape (not shown) is likely. Without a horizontal slot, the barrier tape cannot be slid sideways into the slot 52, but similarly it makes tampering or pilferage of the inserted tape much more unlikely. Chain can be substituted for tape to provide an even more secure modular marker.

Figure 10:
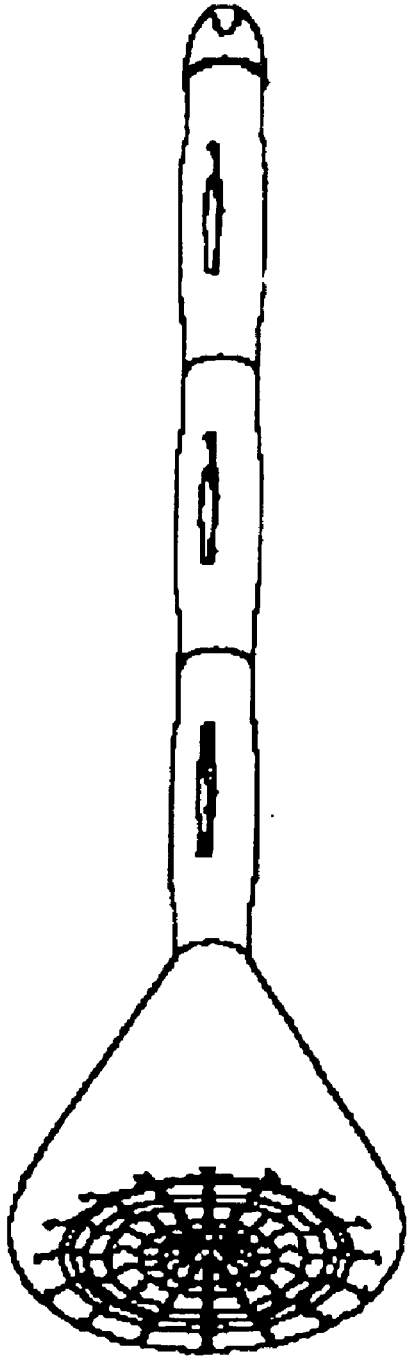
FIG. 10 is a perspective view of the assembled modular marker of the present invention including the base member, three tubular members, and a cap member.
Figure 10A:
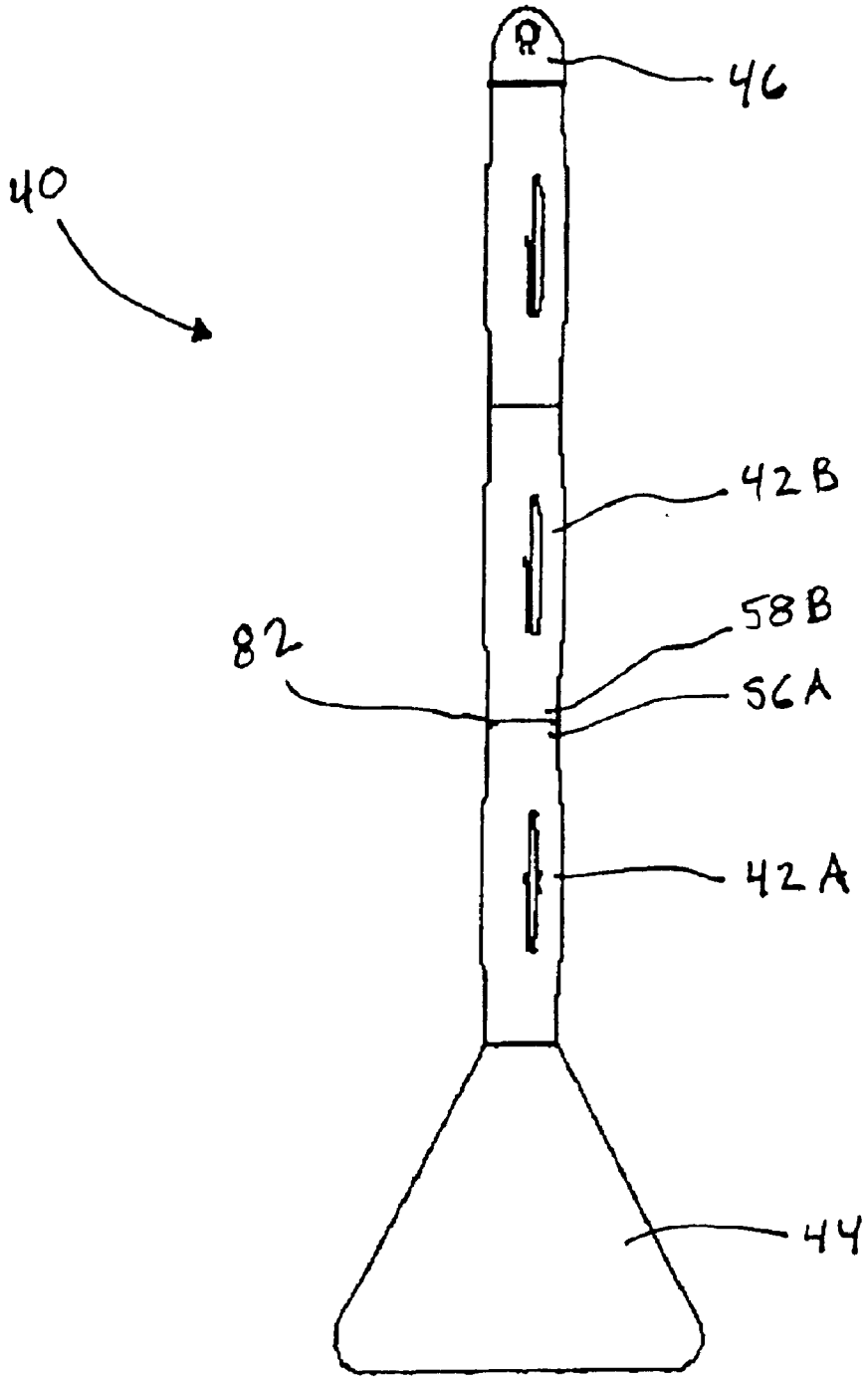
FIG. 10A is a side elevational view of the assembled modular marker of FIG. 10.
Figure 11:
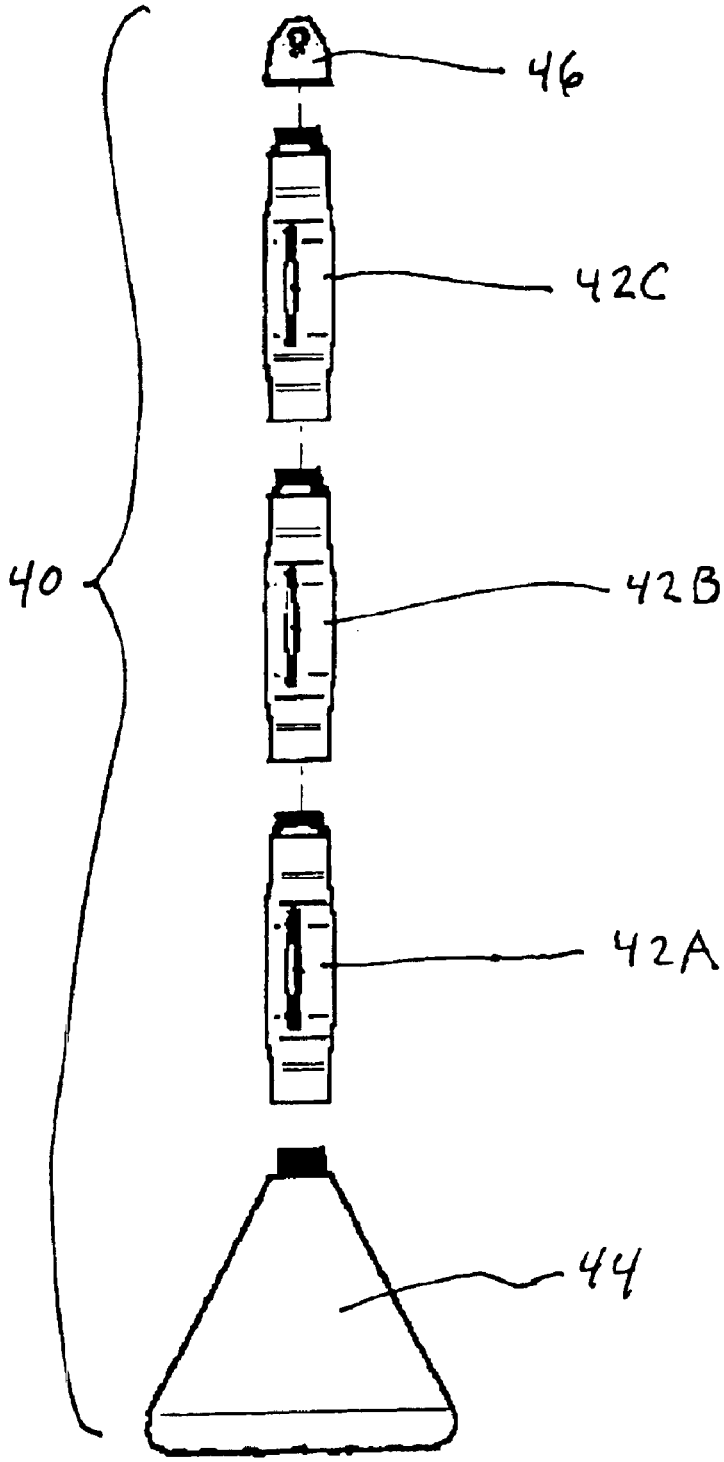
FIG. 11 is a side elevational view of the assembled modular marker of FIG. 10A but with the separate parts exploded away from each other.
Figure 21:
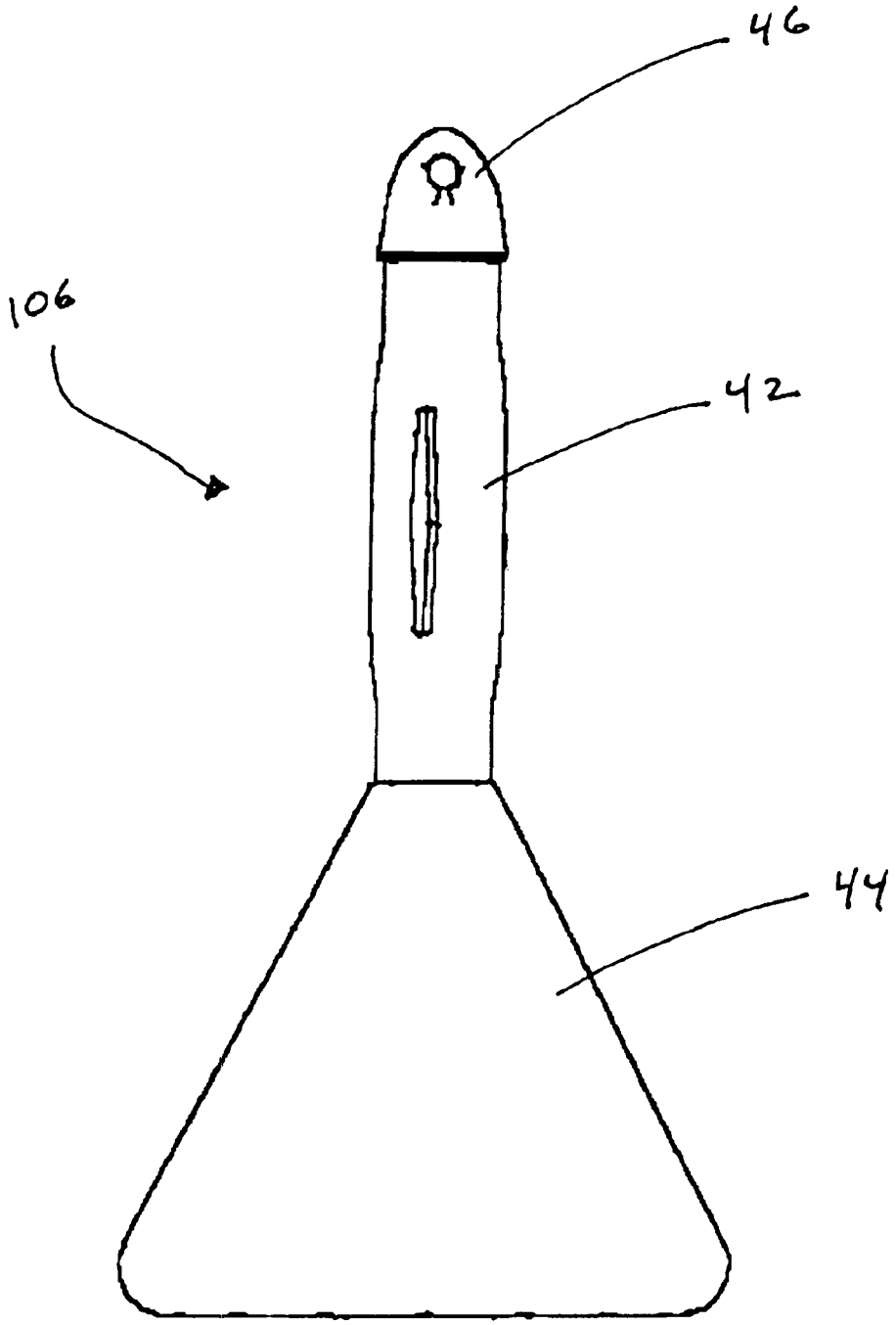
FIG. 21 is a side elevational view illustrating the combination of one tubular member with a cap and base to form a short modular marker.
Figure 22:
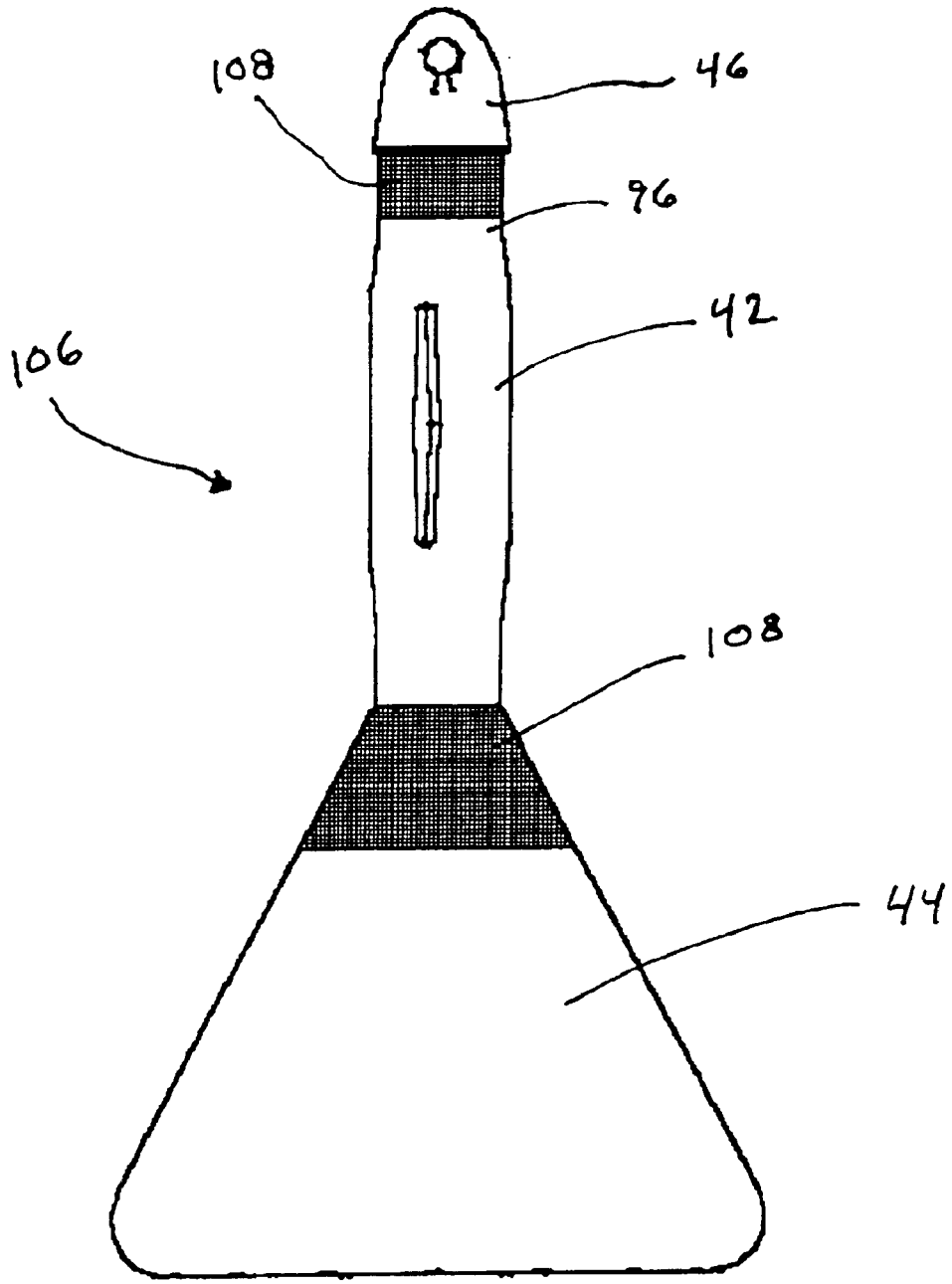
FIG. 22 is a side elevational view of a modular marker having one tubular member and reflective tape attached to the top recessed area and to the base member.
Figure 23:
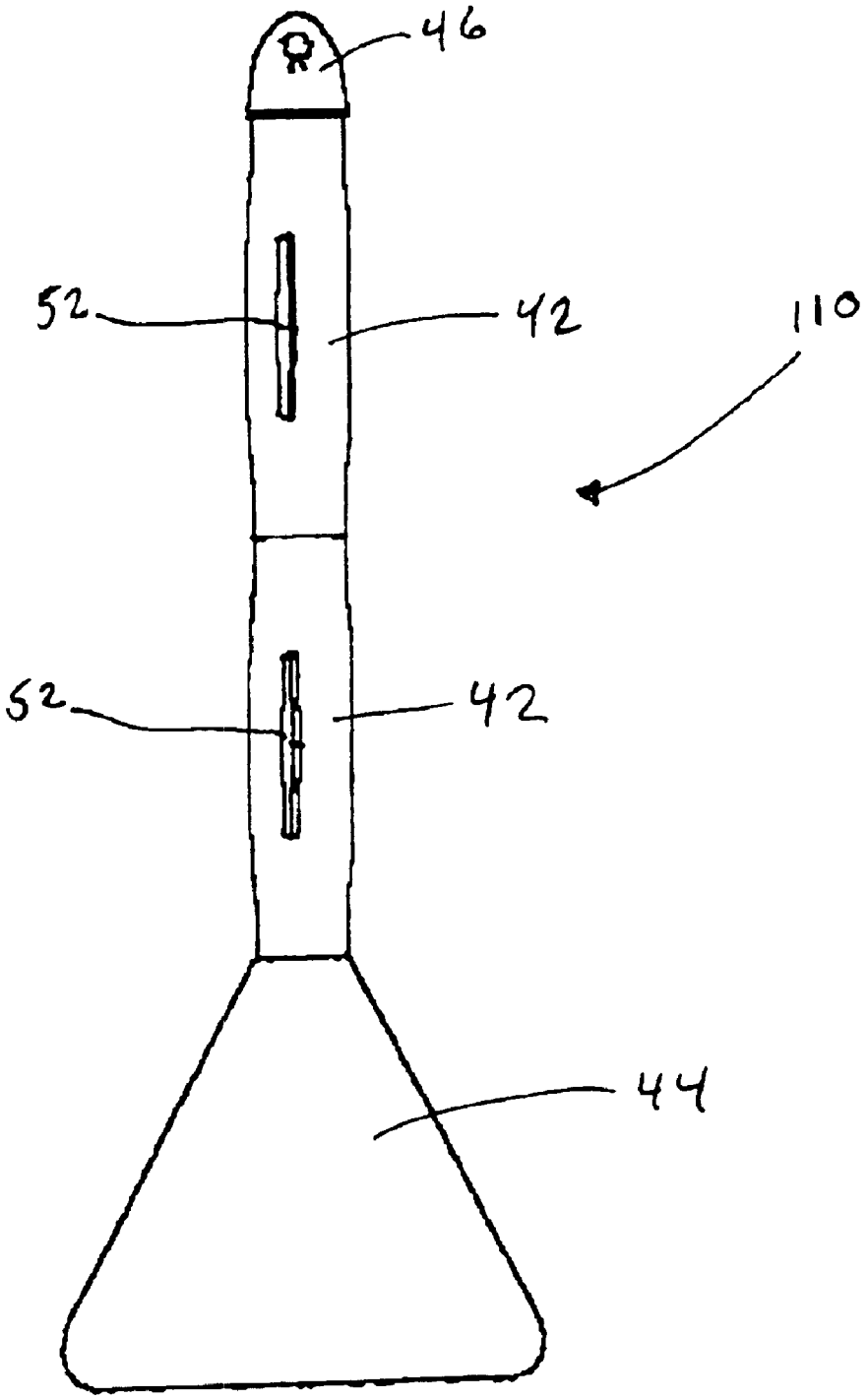
FIG. 23 is a side elevational view illustrating the combination of two tubular members with a cap and base to form a modular marker of intermediate height.

FIG. 11 depicts an exploded view of the various members used to form the modular marker 40 of the present invention, including, from the bottom to the top of the figure, the base member 44, three tubular members 42A, 42B, and 42C, and a cap member 46. The fully assembled modular marker 40 constructed with three tubular members 42 is depicted in FIGS. 10 and 10A. For a modular marker comprised of three tubular members, the tubular members 42 are preferably 11 to 13 inches in length, the cap member 46 preferably 3 inches in length, and the shoulder of the base member 44 typically 12.5 inches off the ground. Assemblage of the preferred embodiments of the base member 44, three tubular members 42, and cap member 46 therefore would produce a modular marker extending to approximately 51 inches from the supporting surface. The modular marker could however easily be assembled with more or less tubular members as desired to tailor the marker for specific applications. FIG. 21, for example, shows a short modular marker 106 created by assembling a base 44 and cap 46 with one tubular member 42. FIG. 22 shows the short marker 106 with one tubular member 42 and reflective tape 108 applied to the recessed area 96 at the top 56 of the tubular member and reflective tape applied to the top of the base member 44. FIG. 23 illustrates a modular marker according to the present invention using two tubular members 42 to form a marker 110 of intermediate height.

Figure 24:
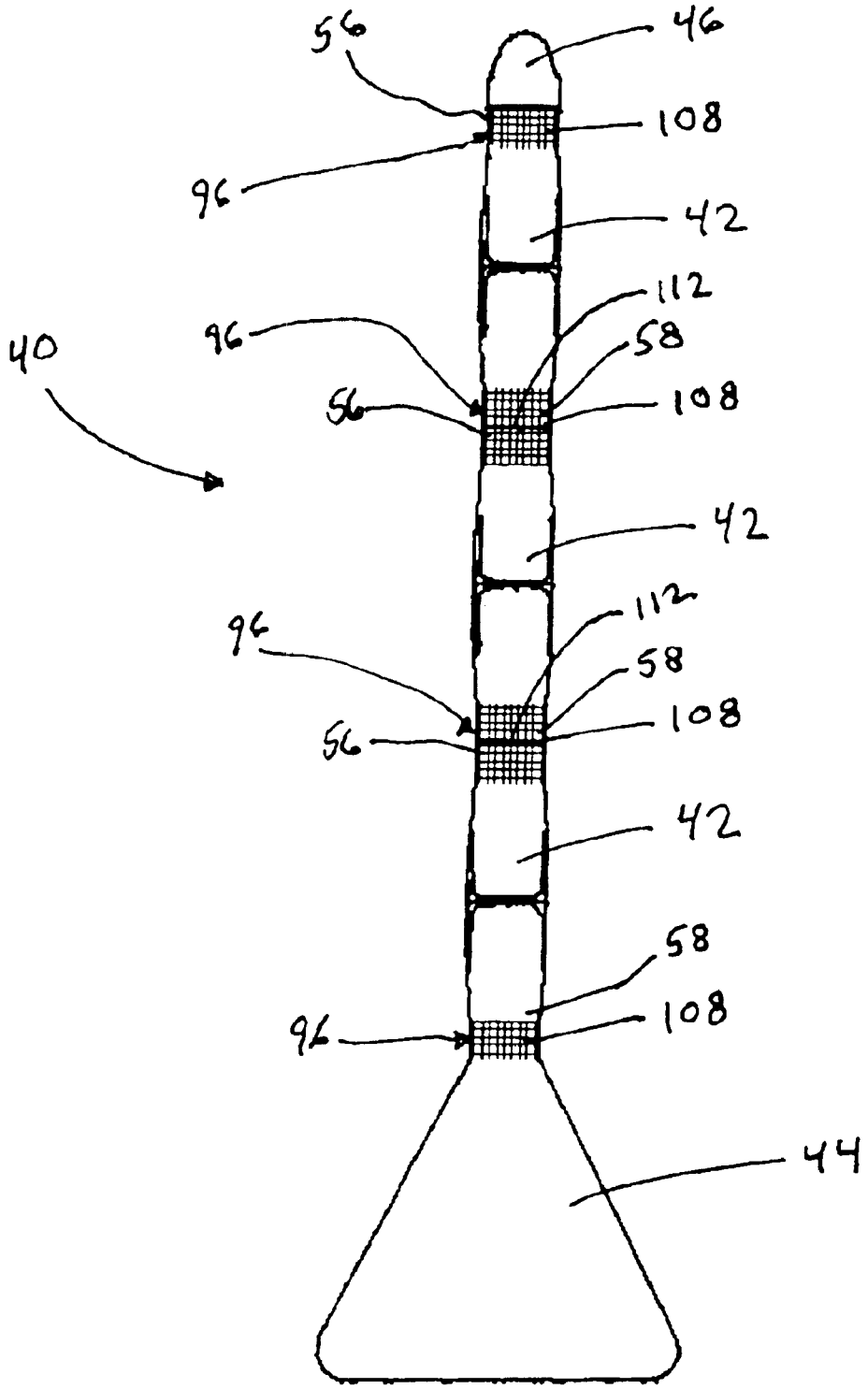
FIG. 24 is a side elevational view of a modular marker having three tubular members with reflective tape attached to the recessed areas below the cap, at the joints between the tubular members, and between the base and lowest tubular member.
Figure 25:
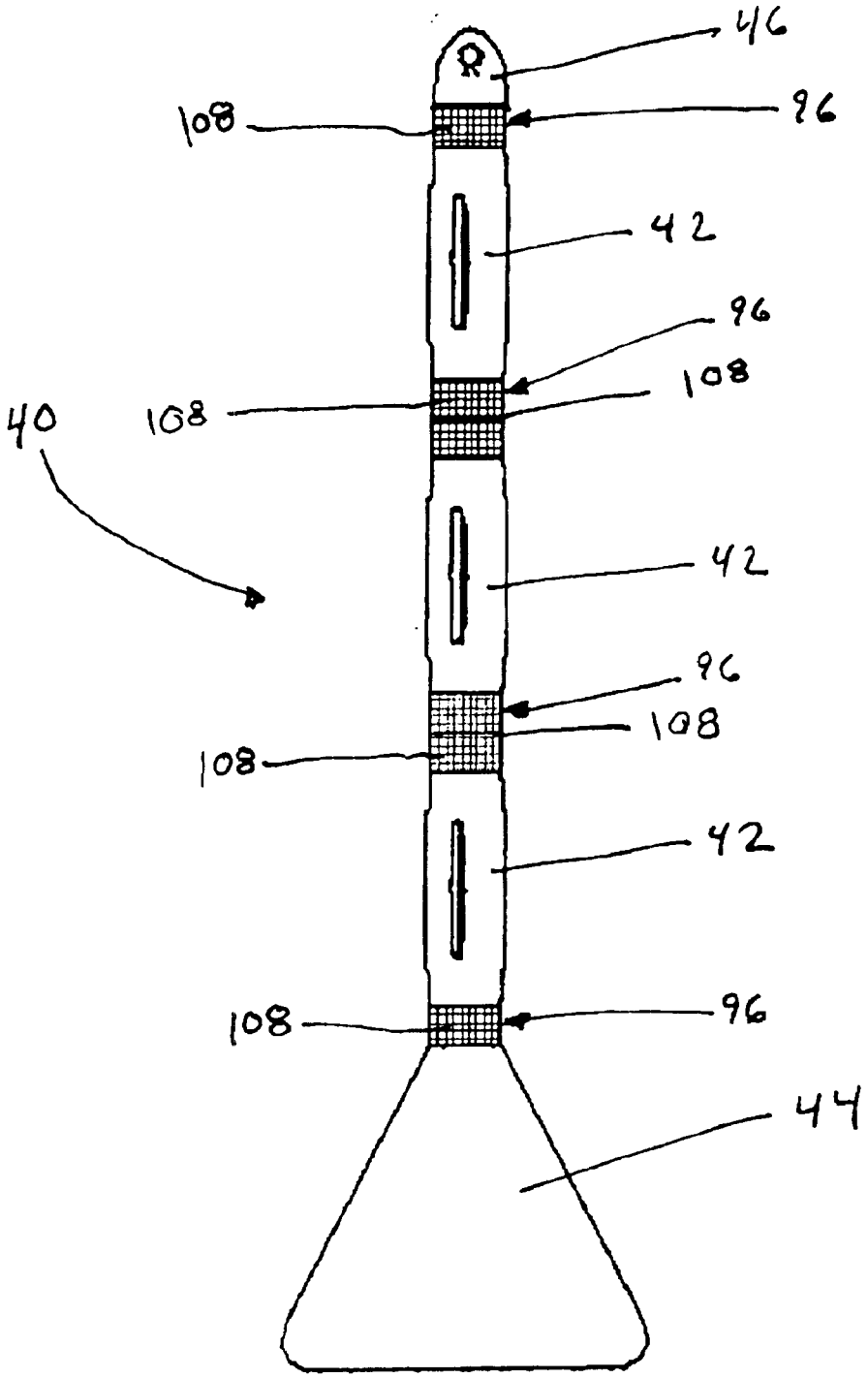
FIG. 25 is a side elevational view of a modular marker constructed with three tubular members according to FIG. 4 and with reflective tape applied at the joints between the sections.

Referring to FIGS. 24 and 25, a modular marker 40 is shown having three tubular members 42 and with reflective tape 108 applied to the recessed areas 96 near the top 56 and bottom 58 of each tubular member. The reflective tape 108 applied to the recessed areas 96 between adjacent tubular members 42 provides the additional benefit of straddling the joint 112 where the adjacent tubular members 42 meet. This provides additional security against theft or tampering by strengthening the joint between the tubular members.

Figure 27:
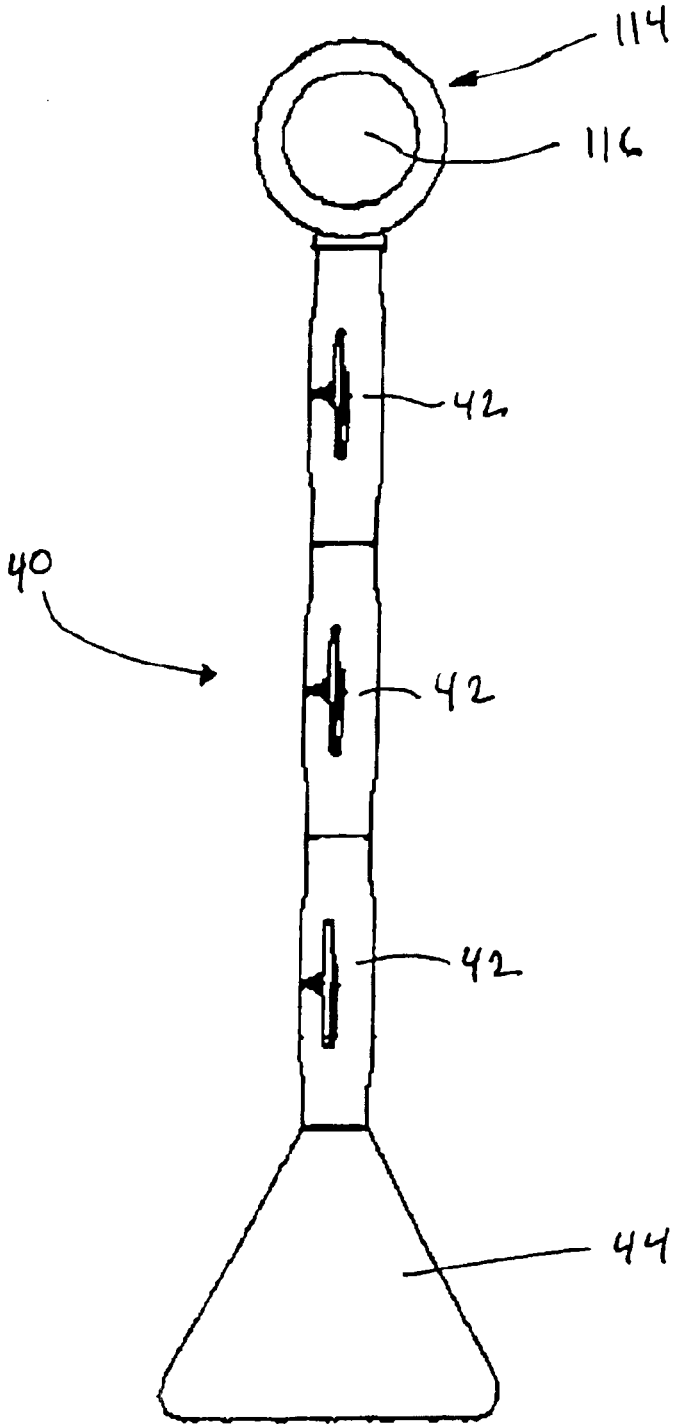
FIG. 27 is a side elevational view of a modular marker constructed with three tubular members according to FIG. 7 and including an alternate cap with a circular panel to which a sign or a reflective material may be attached.

With reference to FIG. 27, a modular marker 40 is shown with an alternate cap member 114 which includes a circular panel area 116 to which a sign, message, or reflective material may be attached.

Figure 28:
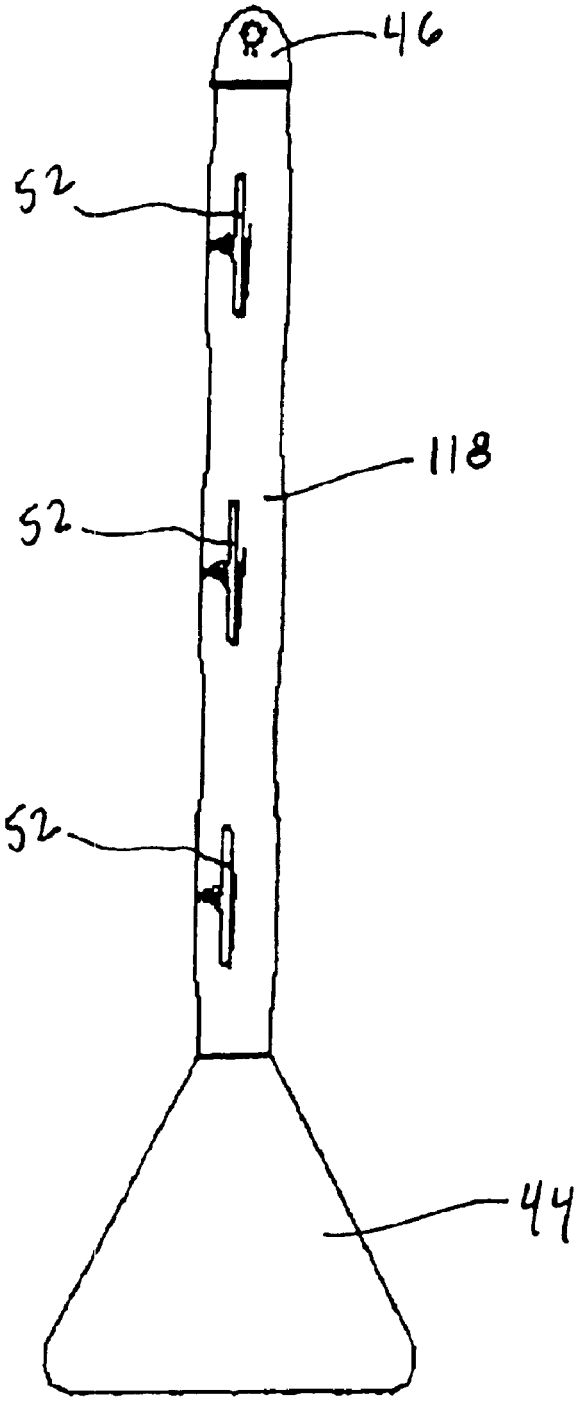
FIG. 28 is a side elevational view of a modular marker constructed with one long tubular member.
Figure 29:
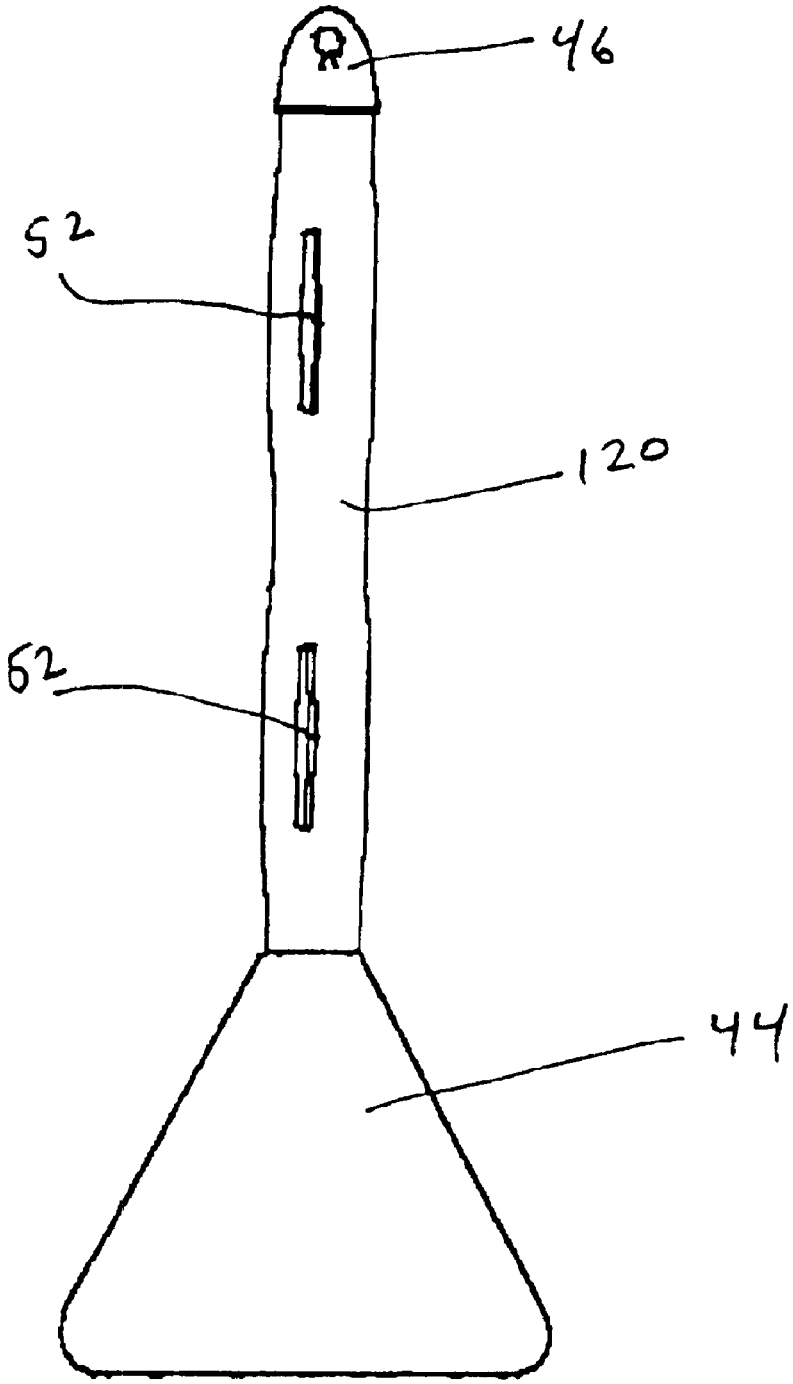
FIG. 29 is a side elevational view of a modular marker constructed with one tubular member of intermediate length.

FIGS. 28 and 29 show alternate embodiments of the tubular members. As shown in FIG. 28, the tubular member 118 may be formed in a long length, with more than one longitudinal slot 52. This limits the flexibility of modifying the modular marker for various heights, but for those applications in which only a tall marker is desired, a long tubular member 118 may be provided such as shown in FIG. 28. Similarly, as shown in FIG. 29, an intermediate length tubular member 120 may be provided for the rapid assemblage of modular markers of intermediate height.

Figure 30A:
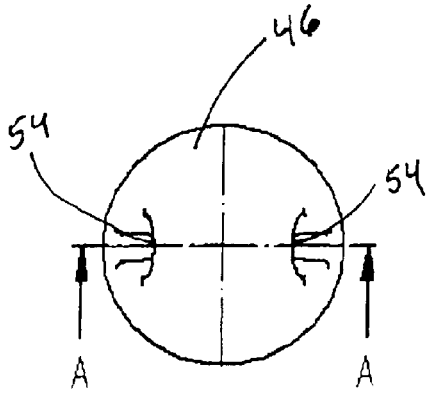
FIG. 30A is a top view of the cap member of FIG. 30.
Figure 30:
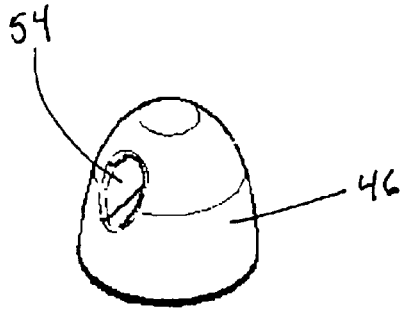
FIG. 30 is a perspective view of a preferred embodiment of a cap member used with the modular marker of the present invention.
Figure 30B:
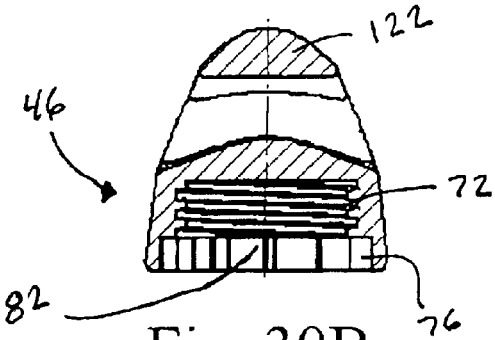
FIG. 30B is a sectional view of the cap member taken along line A—A of FIG. 30A.
Figure 30C:
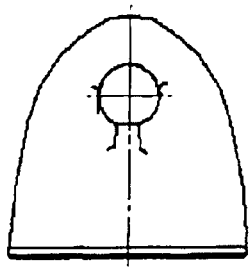
FIG. 30C is a side elevational view of the cap member of FIG. 30.
Figure 30D:
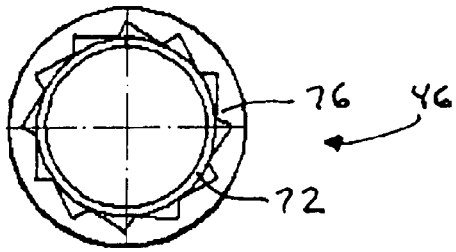
FIG. 30D is a bottom view of the cap member of FIG. 30.

Further details of the cap member 46 of the modular marker can be understood by referring to FIGS. 30, 30A, and 30C. As shown in the perspective view in FIG. 30, the preferred embodiment of the cap member 46 includes an aperture 54. The aperture 54 is provided for constructing barricades using the modular marker wherein a rope, chain, or web of some type is desired at the height of the cap member. As shown in FIGS. 30A and 30C, the aperture 54 typically runs straight through the cap member 46. The cap member is preferably blow molded of a suitable polymer but may also be constructed of wood, metal, or a variety of materials. As shown in the cross-sectional view of FIG. 30B, the cap member 46 includes a solid top portion 122 and the aforementioned security thread arrangement 82 formed in the lower portion.

Figure 12:
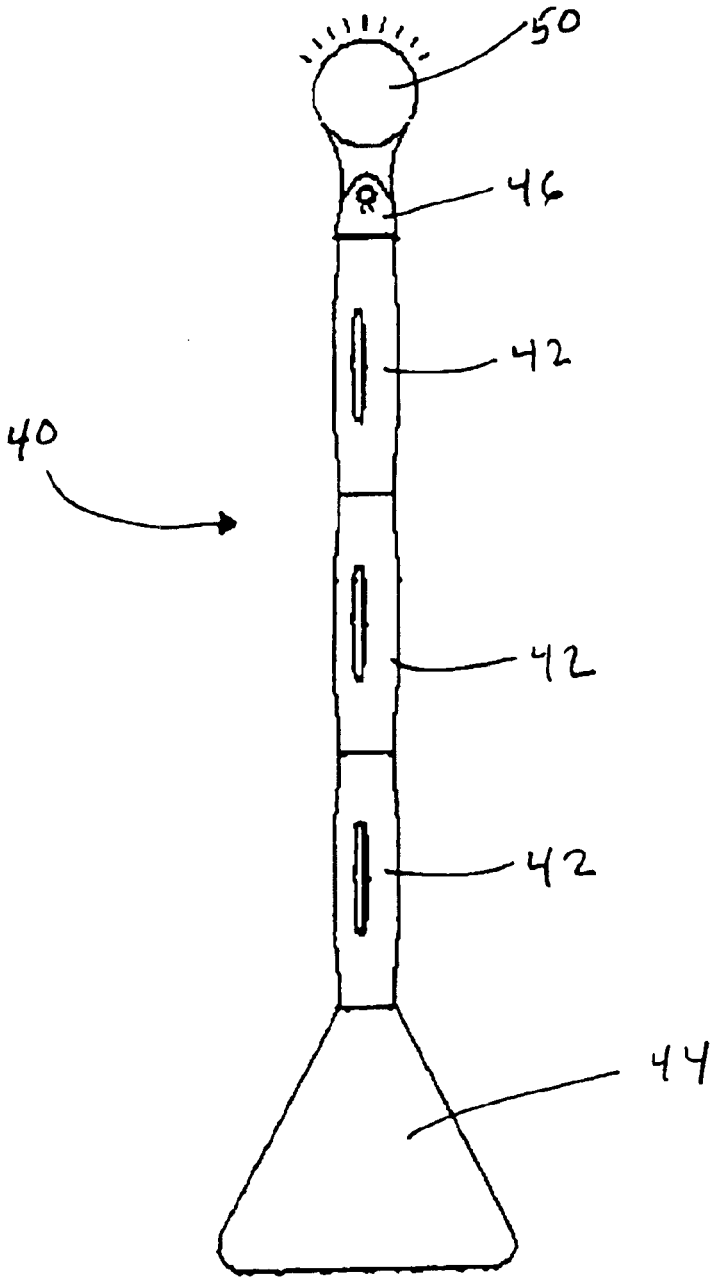
FIG. 12 is a side elevational view of the assembled modular marker of FIG. 10 with a light secured to the cap.

With reference to FIG. 12, the modular marker 40 is shown supporting a caution light 50. The caution lights are commercially available and are typically low-voltage lights with a self-contained battery. A special module may also be provided for use with the modular marker.

Figure 13:
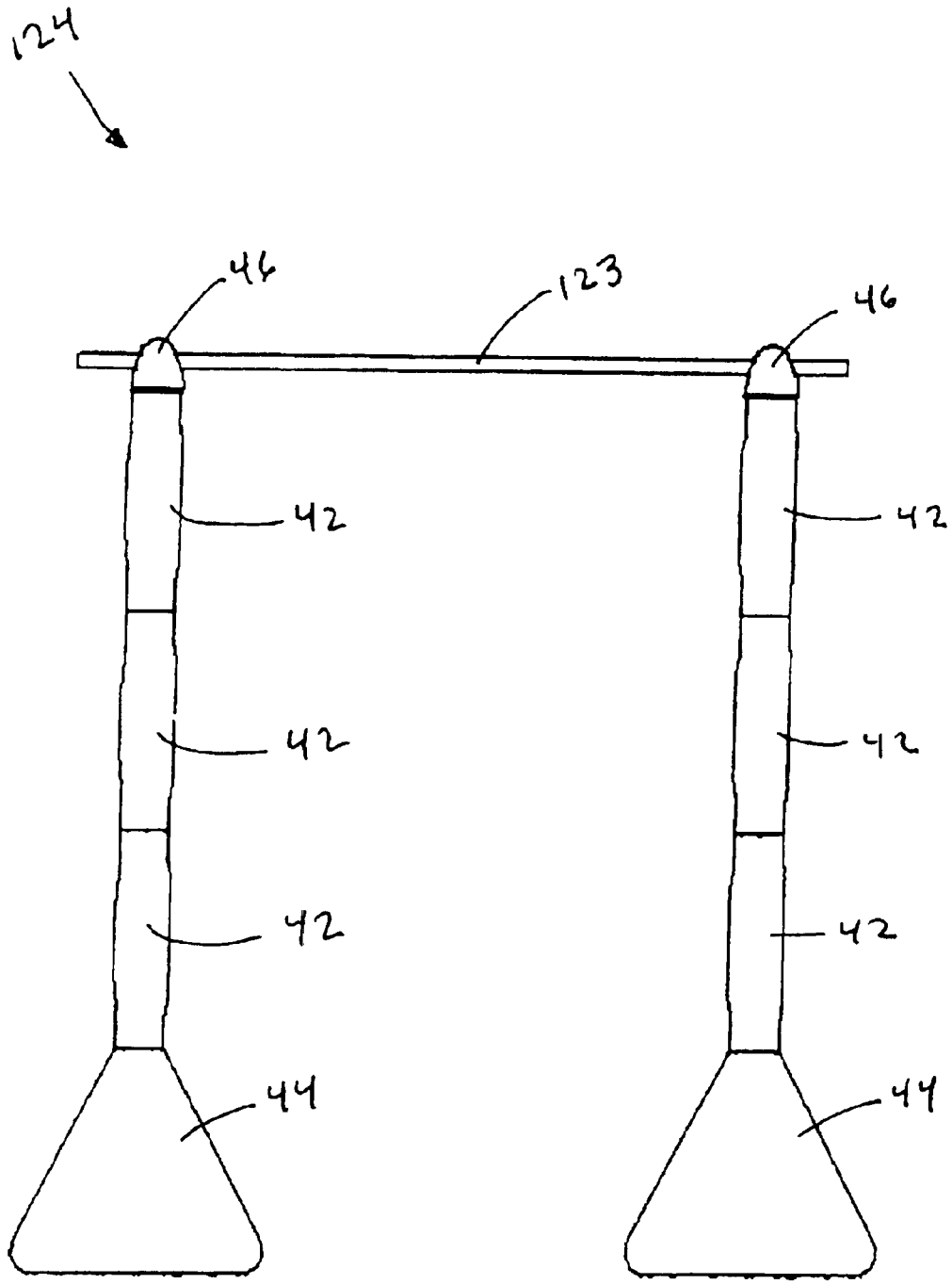
FIG. 13 is a side elevational view of two modular markers according to the present invention joined through the cap portions by a rope.

FIG. 13 illustrates another application of the modular marker 40 of the present invention with a rope 123 inserted through the cap members 46 to form a barricade 124.

Figure 14:
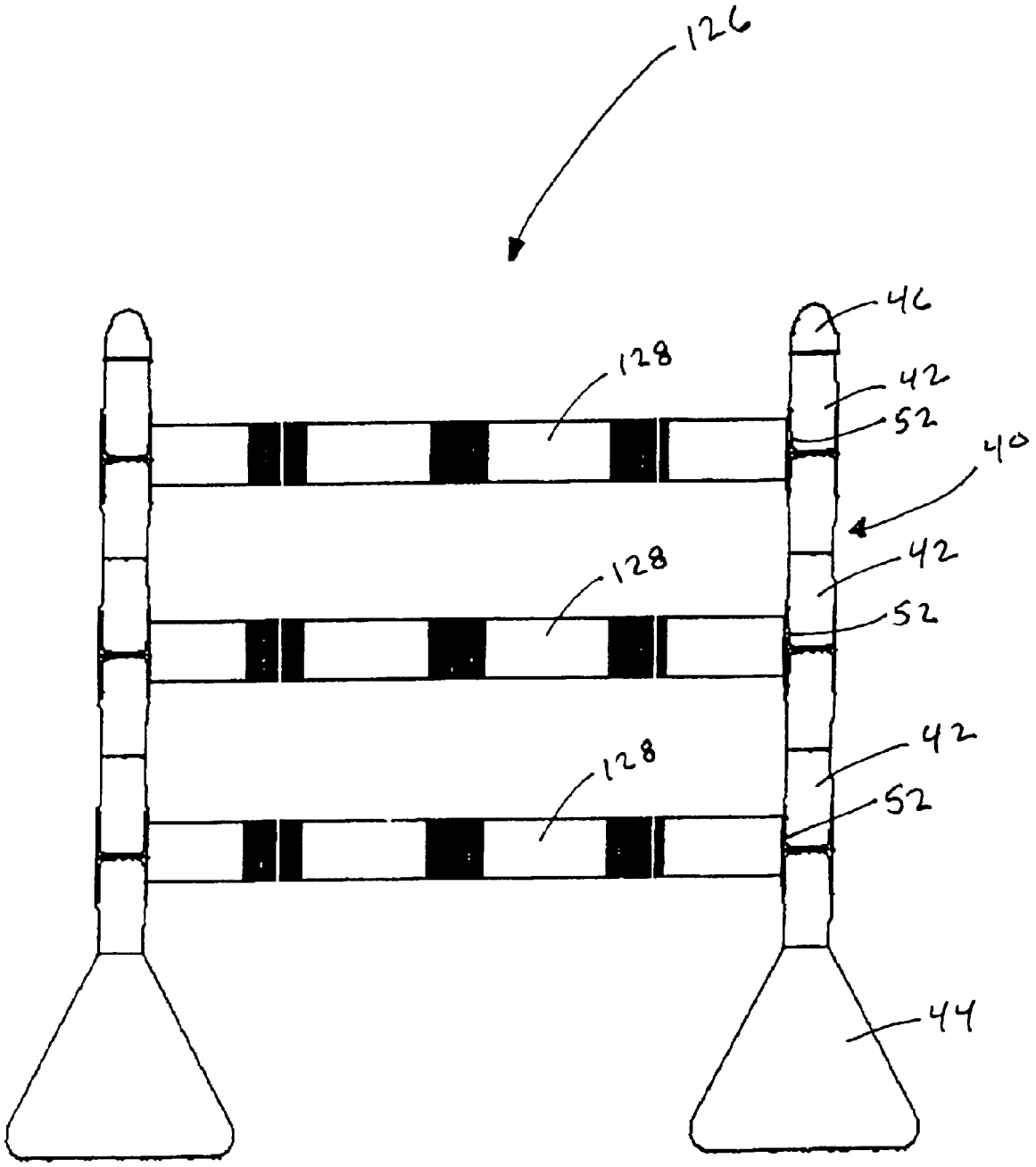
FIG. 14 is a side elevational view of two modular markers according to the present invention connected by three tapes spaced apart vertically and stretched through the longitudinal slots of the tubular members.
Figure 15:
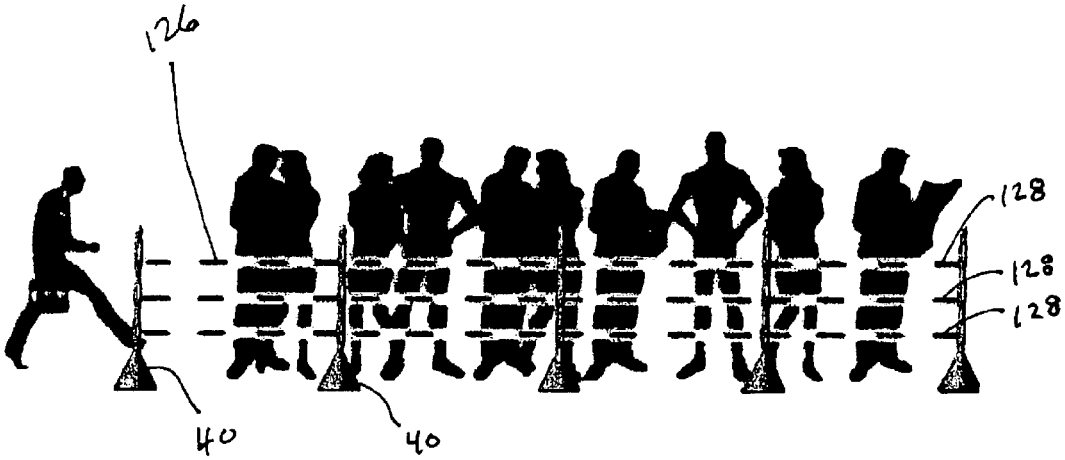
FIG. 15 is a schematic illustrating use of the modular marker and three marker tapes to delineate a barricaded area for the queueing of people.

FIGS. 14 and 15 illustrate a barricade 126 formed using three levels of marker tape 128 that is available commercially. The marker tape 128 is available commercially and, as previously mentioned, may be printed with warning messages such as "WARNING—CONSTRUCTION AREA", "CAUTION—WET FLOOR", "NO PARKING", "WARNING—SAFETY GLASSES REQUIRED", etc. FIG. 15 illustrates how the barricade using three levels of tape can be deployed to delineate a cordoned area for controlling the flow of airline passengers, customers at a bank teller window, etc.

Figure 16:
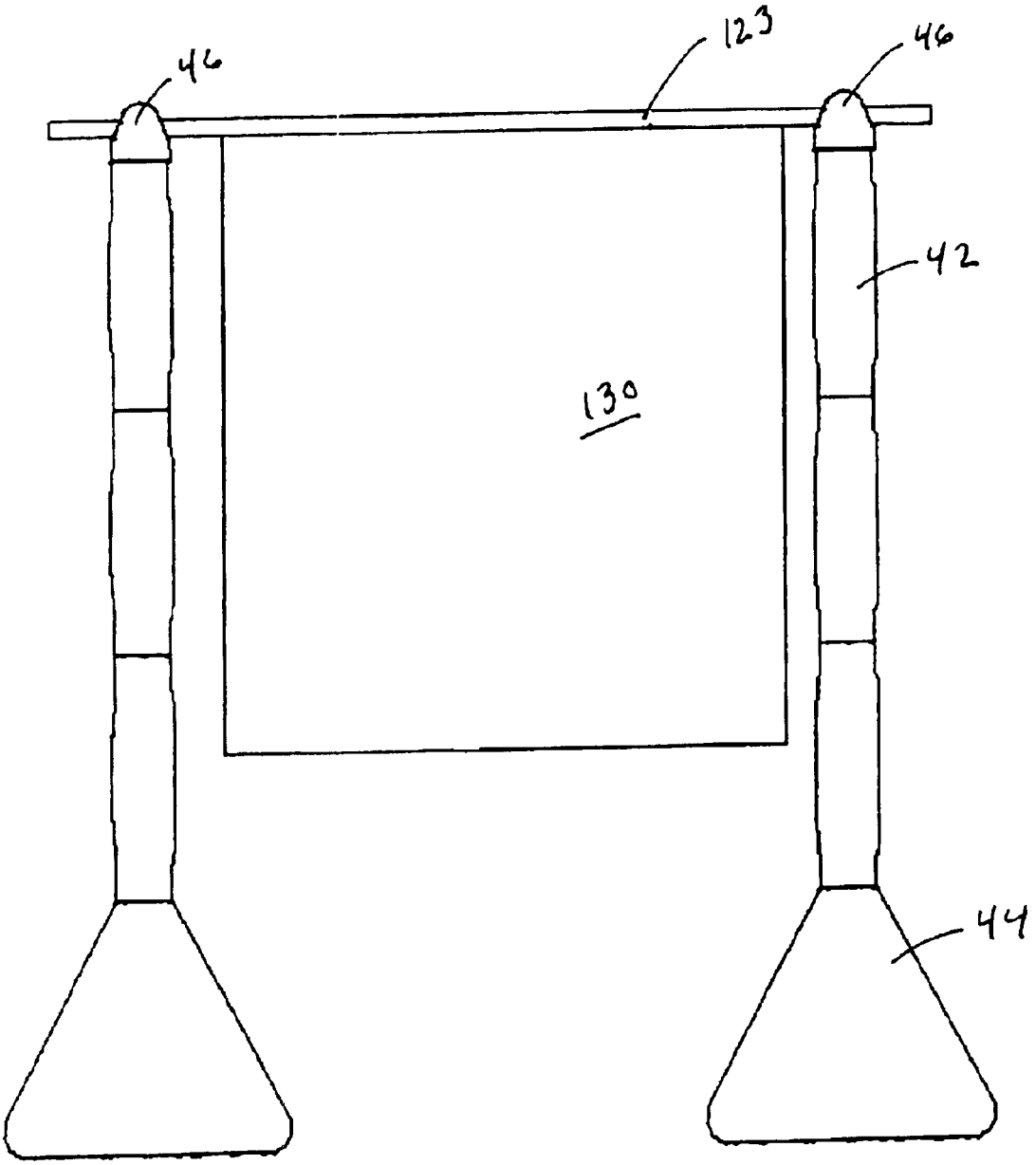
FIG. 16 is a side elevational view of two modular markers with a rope or stiff bar suspended through the cap and having a panel or sign suspended from the rope.
Figure 17:
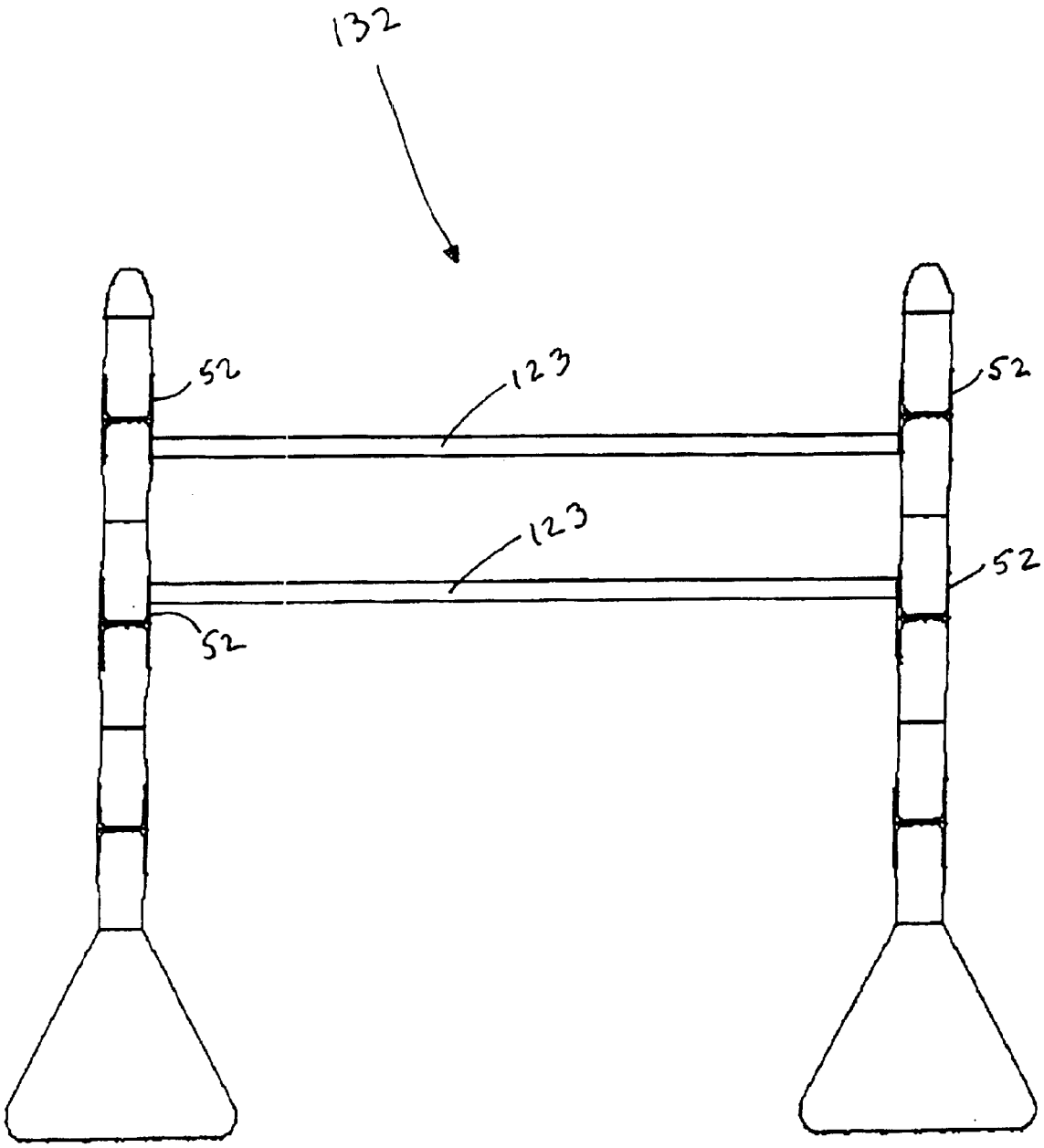
FIG. 17 is a side elevational view of two modular markers according to the present invention holding a barricade.
Figure 18:
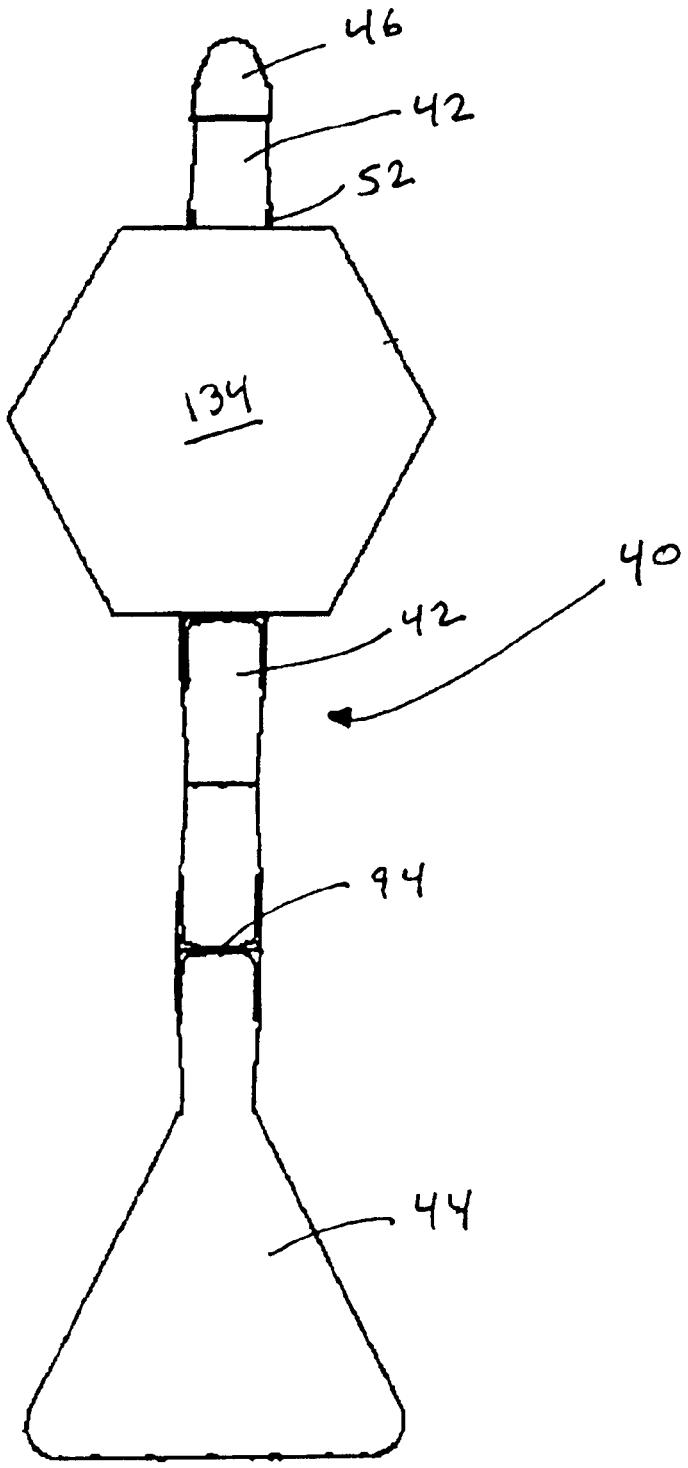
FIG. 18 is a side elevational view of a modular marker according to the present invention holding a sign attached within a longitudinal slot in the top tubular member.
Figure 19:
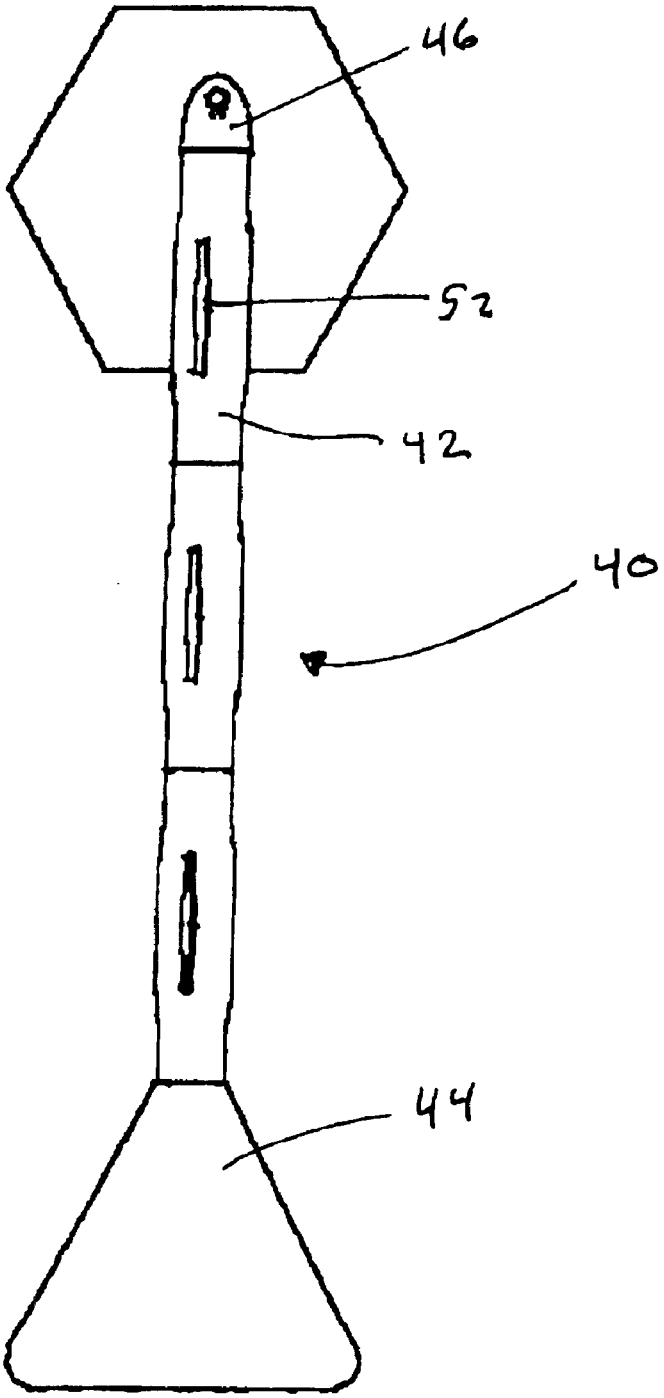
FIG. 19 is a side elevational view of a modular marker according to the present invention illustrating a sign attached to the cap member.
Figure 20:
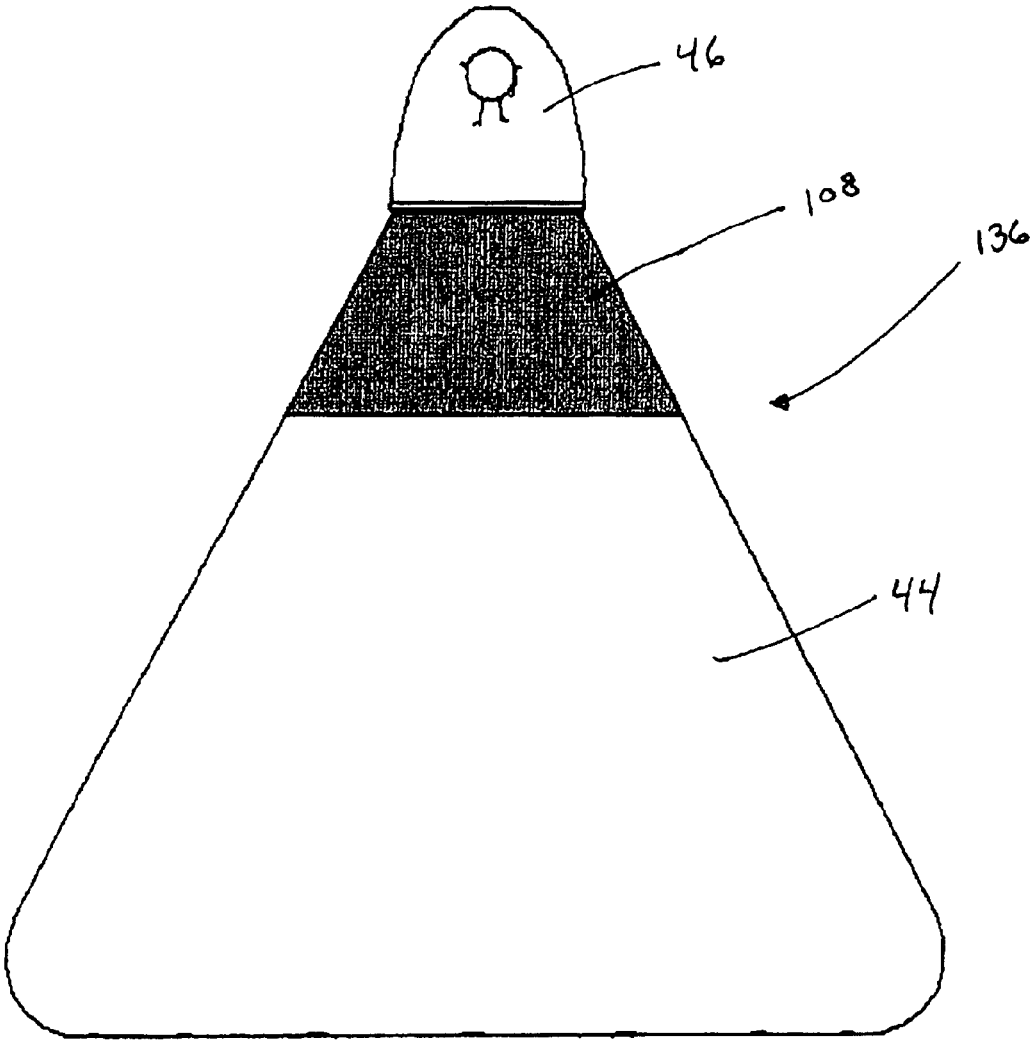
FIG. 20 is a side elevational view showing the cap attached directly to the base member to form a low profile modular marker or a caution cone.

FIGS. 16 through 20 provide illustrations of additional arrangements of the modular marker according to the present invention. FIG. 16, for example, illustrates the suspension of a rope or chain 123 through the cap members 46 to support a large sign or panel 130. FIG. 17 illustrates two modular markers holding a barricade 132 that may consist of rope, chain, wood slats, or metal bars 127 as desired. Wood slats or metal bars would provide a more permanent type of barricade. FIG. 18 illustrates how a sign 134 may be easily attached to a modular marker 40. The sign would typically include an attached horizontal bracket (not shown) that would enable it to slip easily into the horizontal opening 94 and thence into the lower portion of the longitudinal slot 52. FIG. 19 illustrates another sign application, in which the sign 134 is attached to the cap member 46. FIG. 20 illustrates the use of the base member 44 and cap member 46 secured together without any intervening tubular members, in order to provide a short caution cone 136 modular marker. Reflective tape 108 has been applied to the top of the base member 44 for enhanced visibility.

Although the preferred method of manufacturing the tubular member, base member, and cap member of the modular marker is by blow molding an extruded polymer, they could, however, be made by injection molding of polymers or by rotational molding of polymers. The modular pieces of the invention could also be made of wood, metal, or a variety of materials if desired.

The preferred material of construction is high density polyethylene (HOPE), but could also be low density polyethylene, polypropylene, polyvinyl chloride, ABS, nylon, or other appropriate polymeric materials. Various materials could be added to the polymer prior to forming, such as pigments and UV protectors, without departing from the scope of the invention.

The surfaces of all the formed pieces, the tubular members, the base member and the cap member are all formed with rounded edges for enhanced safety during assembly and use of the modular marker.

Although the security thread feature provides secure connection of the modules to one another a feature is provided to allow modules to be disassembled and reassembled in other configurations if desired. Referring to FIG. 26, tubular members that have been fastened together may be taken apart by turning the lower tubular member 42 in a direction counterclockwise to the tubular member 42 above it. A great deal more force must be used than was used to fasten the tubular members 42 when originally joined. This is because the security thread 82 must be overcome. As shown in FIGS. 6, 6B, and 6C, when the lower tubular member is rotated counterclockwise with respect to the upper tubular member, the longitudinal ribs 64 contact the short surface 80 of the lateral teeth 76. So it is possible to separate the tubular members once connected by the security thread, but significantly more force is required. This does however provide the advantage of reconfiguration of the modular marker if necessary.

Referring to FIG. 1, the preferred embodiment of the base member 44 is typically 13.5 inches in inside diameter at the bottom 84 and 11.25 inches in inside height. This allows the preferred embodiment of the base member 44 to hold approximately 19 pounds of water when filled. Alternately, the base could be filled with sand or similar readily available materials. The base member 44 could, however, easily be provided with a larger or smaller base member if desired to provide more or less weight holding capability if needed.

The above descriptions, discussion of the features, and some various specific embodiments and configurations should illustrate the flexibility and novelty of the modular marker according to the present invention. As described above, a significant advantage provided by the modular marker of the present invention is that it is of modular construction, and therefore can easily be tailored at the site to many different configurations to fit the requirements of the application. The modular construction enables the marker to be set up as either a signaling device, capable of displaying a sign, or as a barricade. The modules also enable construction of traffic markers of various heights. The longitudinal slots provide a means to hold barrier tape without any bending, twisting, or knotting of the tape.

Although the drawings show many specific features and examples of the modular marker of the present invention, it should be apparent to one skilled in the art that many features could be modified without departing from the scope of the invention.

So therefore, while the invention has been described by reference to the preferred embodiment disclosed herein, the invention is subject to considerable modification and may be tailored to fit the needs of many specific traffic control and marker needs without departing from the scope or spirit of the claims that are appended hereto.

What is claimed is:

1. A modular marker device comprising:

a base member;

a first tubular member extending vertically from said base member;

additional tubular members extending vertically from said first tubular member;

a cap member at the topmost of said tubular members;

a fastening and locking arrangement securing said tubular members to said base member and said additional tubular members to each other;

an integral vertical slot in said tubular members;

a first and second end on said tubular member;

an extension on said first end;

a shoulder at the junction of said extension with said first end;

exterior threads on said extension;

one or more longitudinal ribs on said extension adjacent said exterior threads;

said second end including an inner periphery;

a plurality of lateral teeth on said inner periphery;

said teeth including a long surface and a short surface; and interior threads on said inner periphery adjacent said teeth.

2. The modular marker device of claim 1 wherein said vertical slot includes a horizontal opening into said slot from the outer periphery of said tubular member.

3. The modular marker device of claim 1 wherein said tubular member includes recessed areas having cylindrical outer peripheries adjacent said first and second ends.

4. The modular marker device of claim 1 wherein said slot is defined by side walls through said tubular member with said side walls of a wider spacing at the outer edge of said tubular member and of a narrower spacing at the center of said tubular member.

5. The modular marker device of claim 1 wherein said cap member includes an aperture therein.

6. The modular marker device of claim 1 wherein the diameter across said lateral teeth on said second end is less than the diameter across said longitudinal ribs on said extension thereby causing said ribs to engage said teeth when two of said tubular members are rotatably joined.

7. The modular marker device of claim 1 wherein said tubular members are secured to one another by rotation of said exterior threads on said first end into said interior threads on said second end and rotation of said ribs along said long surface of said teeth until said shoulder contacts said second end.

* * * * *